US009903221B2

(12) United States Patent
Jacobs et al.

(10) Patent No.: US 9,903,221 B2
(45) Date of Patent: Feb. 27, 2018

(54) ELECTRONICALLY CONTROLLABLE AND TESTABLE TURBINE TRIP SYSTEM AND METHOD WITH REDUNDANT BLEED MANIFOLDS

(71) Applicant: EMERSON PROCESS MANAGEMENT POWER & WATER SOLUTIONS, INC., Pittsburgh, PA (US)

(72) Inventors: Jay Michael Jacobs, Pittsburgh, PA (US); Thomas Sweeney, Sarver, PA (US); Daniel Philip Berkepile, North Huntington, PA (US); Adam Gregory Redling, Aspinwall, PA (US); Michael Henry Winwood, Gibsonia, PA (US)

(73) Assignee: EMERSON PROCESS MANAGEMENT POWER & WATER SOLUTIONS, INC., Pittsburgh, PA (US)

( * ) Notice: Subject to any disclaimer, the term of this patent is extended or adjusted under 35 U.S.C. 154(b) by 520 days.

(21) Appl. No.: 13/913,159

(22) Filed: Jun. 7, 2013

(65) Prior Publication Data

US 2013/0327408 A1 Dec. 12, 2013

Related U.S. Application Data

(60) Provisional application No. 61/657,366, filed on Jun. 8, 2012.

(51) Int. Cl.

| | |
|---|---|
| ***F01D 21/16*** | (2006.01) |
| ***F16D 31/02*** | (2006.01) |
| ***F01D 21/18*** | (2006.01) |

(52) U.S. Cl.

CPC ..... *F01D 21/16* (2013.01); *F01D 21/18* (2013.01); *Y10T 137/0324* (2015.04); *Y10T 137/86493* (2015.04)

(58) Field of Classification Search

CPC ..... F01D 21/16; F01D 21/18; F01D 21/20; F15B 20/004; F15B 2211/8633

(Continued)

(56) References Cited

U.S. PATENT DOCUMENTS

| | | | |
|---|---|---|---|
| 2,524,052 | A | 10/1950 | Grant, Jr. |
| 3,589,387 | A | 6/1971 | Raymond |

(Continued)

FOREIGN PATENT DOCUMENTS

| | | |
|---|---|---|
| CN | 1854470 | 11/2006 |
| DE | 31 38 562 | 4/1983 |

(Continued)

OTHER PUBLICATIONS

Search Report for Application No. GB1310225.6, dated Nov. 27, 2013.

(Continued)

*Primary Examiner* — Michael Leslie
*Assistant Examiner* — Richard Drake
(74) *Attorney, Agent, or Firm* — Marshall, Gerstein & Borun LLP

(57) ABSTRACT

A trip control system for use with, for example, turbines, includes a porting manifold that supports and provides fluid to two or more trip manifolds, each of which includes a bleed circuit having two or more bleed valves connected in parallel between a trip header line and a return or dump line to bleed the hydraulic fluid pressure from the trip header line to thereby cause a trip. The trip control system includes redundant trip manifolds operating in parallel, wherein each trip manifold is able to independently engage a trip of the turbine and each of the trip manifolds includes redundant sets of valves and other trip components that enable the trip manifold to operate to engage a trip of the turbine in the presence of a failure of one of the sets of components on a (Continued)

trip manifold, or while various components of the trip manifold are being tested.

3 Claims, 7 Drawing Sheets

(58) Field of Classification Search
USPC ..... 60/448, 449, 454; 91/406, 448; 137/487.5
See application file for complete search history.

(56) References Cited

U.S. PATENT DOCUMENTS

| | | | | |
|---|---|---|---|---|
| 4,343,454 | A | 8/1982 | Kure-Jensen et al. | |
| 4,464,577 | A | 8/1984 | Wagner et al. | |
| 4,474,013 | A | 10/1984 | Chamberlain | |
| 4,585,205 | A | 4/1986 | Coppola et al. | |
| 4,929,148 | A | 5/1990 | Nutter | |
| 5,082,245 | A | 1/1992 | Kast | |
| 5,086,803 | A | 2/1992 | Nakajima | |
| 5,211,196 | A | 5/1993 | Schwelm | |
| 5,217,199 | A * | 6/1993 | Frey | F01D 21/20 251/29 |
| 5,269,490 | A | 12/1993 | Fujikawa et al. | |
| 5,303,733 | A | 4/1994 | Nelson | |
| 5,316,347 | A | 5/1994 | Arosio et al. | |
| 5,346,360 | A | 9/1994 | Cooper | |
| 5,561,976 | A | 10/1996 | Chu et al. | |
| 5,610,341 | A | 3/1997 | Tortora | |
| 5,813,226 | A | 9/1998 | Krone et al. | |
| 5,860,445 | A | 1/1999 | Yoshimura et al. | |
| 5,878,647 | A * | 3/1999 | Wilke | F15B 11/05 137/596.16 |
| 5,945,591 | A | 8/1999 | Saarem | |
| 5,983,921 | A | 11/1999 | Miyazoe et al. | |
| 6,102,062 | A | 8/2000 | Pearl, II et al. | |
| 6,257,277 | B1 | 7/2001 | McGeachy | |
| 6,349,735 | B2 | 2/2002 | Gul | |
| 6,382,589 | B1 | 5/2002 | Edstrom, Sr. et al. | |
| 6,405,815 | B1 | 6/2002 | Stoever et al. | |
| 6,484,587 | B2 | 11/2002 | Gul | |
| 6,675,829 | B2 | 1/2004 | Moore, Jr. et al. | |
| 6,691,604 | B1 | 2/2004 | Hajek, Jr. et al. | |
| 6,729,135 | B1 | 5/2004 | Norris et al. | |
| 6,830,067 | B2 | 12/2004 | Hayashi | |
| 6,860,290 | B2 | 3/2005 | Knuthson | |
| 6,871,576 | B2 | 3/2005 | Vari | |
| 6,921,244 | B2 | 7/2005 | Johnson | |
| 7,137,407 | B2 | 11/2006 | Sweeney et al. | |
| 7,444,920 | B2 * | 11/2008 | Herrmann | F15B 11/042 91/433 |
| 7,874,241 | B2 | 1/2011 | Natili, Jr. et al. | |
| 7,909,064 | B2 | 3/2011 | Natili, Jr. et al. | |
| 2006/0230755 | A1 | 10/2006 | Natili et al. | |

FOREIGN PATENT DOCUMENTS

| | | |
|---|---|---|
| DE | 40 33 050 | 8/1991 |
| DE | 42 22 193 | 1/1993 |
| DE | 20 2007 001232 | 10/2006 |
| EP | 0 641 919 | 3/1995 |
| EP | 1 357 325 A2 | 10/2003 |
| EP | 1 878 958 | 7/2006 |
| GB | 0 861 982 A | 3/1961 |
| GB | 2 423 340 A | 8/2006 |
| JP | 61-129408 | 6/1986 |

OTHER PUBLICATIONS

Canadian Office Action for Application No. 2,533,956, dated Feb. 22, 2013.
Canadian Office Action for Application No. 2,540,346, dated Feb. 19, 2013.
Chinese Office Action for Application No. 200610057627.6, dated Jun. 5, 2009.
Chinese Office Action for Application No. 200610057627.6, dated May 7, 2010.
Chinese Office Action for Application No. 200810133353.3, dated Jul. 31, 2012.
Chinese Office Action for Application No. 200810133353.3, dated May 31, 2013.
Combined Search and Examination Report for Application No. GB1010082.4, dated Jul. 1, 2010.
Continental Hydraulics, "PowrFlow.TM. Directional Control Valves," Catalog Available at <URL: http://continentalhydraulics.brandspringsolutions.com/UserFiles/File/prod-uctPDF/DirCtrIVIv.pdf>.
Continental Hydraulics, "Wash Down Option Valves, Solenoid Actuated, Direct Operating," New VSD03M Available at <URL: http://www.continentalhydraulics.com/Wash.sub.--Down.sub.--D03.sub.--Cat.-sub.--Supp.pdf>.
Daman Products Company, Inc., "Directional Valve Patterns."
Emergency Tripping System—"Using Hydraulic Trip-Reset Pilots Tanden Compound Turbine with Trip Anticipator" (Nov. 1968).
European Search Report for 08162092.4 dated Jul. 9, 2009.
Examination Report for Application No. GB0603453.2, dated Aug. 9, 2010.
Examination Report for Application No. GB0603453.2, dated Feb. 17, 2010.
Examination Report for Application No. GB0607676.4, dated Aug. 15, 2006.
Examination Report for Application No. GB0607676.4, dated Feb. 22, 2010.
Examination Report for Application No. GB0607676.4, dated Sep. 2, 2010.
Gerhard J. Weiss, "Electronic Overspeed Turbine Protection Without Real Overspeed Test—Valve Test With Single Valve Arrangement," Proceedings of 2000 International Joint Power Generation Conference, Miami Beach, Florida, Jul. 23-26, 2000.
German Office Action for Application No. 10 2006 007 880.2, dated Oct. 21, 2011.
Leechek, "Lee Presents O .187 Lo-Lohm Chek," (2002) Retrieved from the Internet on Oct. 26, 2005: URL:http://www.microhydraulics.com/VALVWEB2.NSF/4c8c908c6ad08610852563a90-05dae17/0b9ed91b6 . . . Internet site no longer active.
Partial European Search Report for Application No. 08162092, dated Apr. 27, 2009.
Philippine Office Action for Application No. 12006000197, dated May 30, 2010.
Protective Devices—"Low Vacuum, Low Bearing Oil Pressure, Thrust Bearing & Solenoid Operated Trips" (Mar. 26, 1968).
Ronald Hitzel et al., "Retrofitting Steam Turbines With Modern Control Platforms," Siemens Westinghouse PowerGEN 2003—Las Vegas, Nevada Dec. 9-11.
Search Report for Application No. GB0814460.2, dated Dec. 5, 2008.
Search Report for Application No. GB0603453.2, dated Jun. 14, 2006.
Chinese Office Action for Application No. 2013103213077, dated Sep. 22, 2015.
Chinese Office Action for Application No. 201310321307.7, dated Apr. 10, 2017.
Chinese Office Action for Application No. 201310321307.7, dated Nov. 2, 2016.

* cited by examiner

ELECTRONICALLY CONTROLLABLE AND TESTABLE TURBINE TRIP SYSTEM AND METHOD WITH REDUNDANT BLEED MANIFOLDS

CROSS REFERENCE TO RELATED APPLICATIONS

The present application claims the benefit of U.S. Provisional Application No. 61/657,366, filed on Jun. 8, 2012, which is hereby incorporated by reference herein in its entirety.

TECHNICAL FIELD

This patent relates generally to a redundant electronically controllable and testable trip system for use with, for example, a turbine and, more particularly, to an apparatus and method for controlling and testing turbine trip components while a turbine is operating in a manner that does not prevent the turbine from being tripped during the test and in a manner that enables disconnection and removal of bleed components of the trip system while the turbine trip system is operating on-line.

BACKGROUND

Hydraulic control systems are commonly used to control power generation machines, such as turbines. Known hydraulic control systems may include a trip control system or other protection system configured to stop the turbine (i.e., trip the turbine) upon the detection of an abnormal operating condition or other system malfunction. Unfortunately, the failure of one or more components associated with the trip control system to operate properly can prevent a turbine trip operation from occurring during emergency situations, which can lead to extensive damage to the turbine as well as other catastrophes, such as harm or injury to plant personnel.

Existing emergency trip systems such as, for example, the mechanical emergency trip system manufactured by General Electric Company (GE), include several components (e.g., valves, governors, blocks, ports, etc.) piped together to form a mechanically operated trip system. In a purely mechanical version, block and bleed functions are performed using non-redundant hydraulically actuated valves. However, in some cases, this system has been retrofit to include electronically controlled redundant bleed valves that perform a bleed operation to dump or remove pressure from a steam valve trip circuit that operates the turbine based on a two-out-of-three voting scheme. Once a bleed operation is performed, however, the GE mechanical trip system requires that the delivery of hydraulic fluid to the control port of the steam valve be blocked. Such a mechanical system results in a large, complex design having separate parts that may be expensive to manufacture. Additionally, the GE mechanical trip system requires an operator to manually perform tests of the blocking components. Still further, the mechanical nature of the blocking system of the GE mechanical trip system requires that an operator travel to the site of the turbine, which is undesirable.

While automatic trip systems have been developed in which the mechanical governor and associated linkages are replaced with a controller that automatically performs a trip operation, such automatic tripping systems typically include single, isolated valves or are limited to the bleed functionality of the tripping system. In particular, as described above with respect to the retrofit GE turbine system, it is known to use a set of three control valves connected to a controller to perform a two out of three voting scheme for performing a bleed function within a turbine trip control system. In this configuration, each of the control valves operates two DIN valves which are connected to one another in a manner that assures that, if two out of the three control valves are open, a hydraulic path is created through a set of two of the DIN valves to cause pressure to be bled from the trip port of the steam valve that provides steam to the turbine. The loss of pressure at the trip port of the steam valve closes the steam valve and trips or halts the operation of the turbine. With this configuration, the failure of any one of the control valves will not prevent a trip operation from being performed when desired or required and likewise, will not cause a trip to occur when such a trip is not desired. Additionally, because of the two out of three voting scheme, the individual components of this bleed circuit can be tested while the turbine is in operation without causing a trip to occur.

Unfortunately, the block circuit or block portion of a trip control system is an important part of the control circuit and, in many systems, there is no manner of being able to provide redundancy in the block circuit to assure proper operation of the block circuit if one of the components thereof fails, and no manner of electronically testing or operating the block circuit. In fact, the block circuit of many known turbine trip control systems must be operated manually, which is difficult to do as it requires an operator to go to and actually manually operate components of the block circuit (generally located near the turbine) after the bleed portion of the trip operation has occurred. Likewise, in systems that use manually operated components, there is no simple remote manner of testing the operation of the block portion of the trip control system.

In an attempt to address many of the shortcomings of these systems, U.S. Pat. No. 7,874,241 discloses a trip control system for use with, for example, turbines, that includes a block circuit having two or more redundant blocking valves connected in series within a pressure supply line to block the supply of hydraulic fluid within the pressure supply line and a bleed circuit having two or more bleed valves connected in parallel between the trip line and a return or dump line to bleed to the hydraulic fluid from the trip. The blocking valves and the bleed valves are actuated by one or more control valves under control of a process or safety controller which operates to cause a trip by first performing a bleed function using at least one of the bleed valves and then a block function using at least one of the blocking valves. Additionally, pressure sensors are disposed at various locations within the tripping control system and provide feedback to the controller to enable the controller to test each of the blocking and bleed valves individually, during operation of the turbine, without causing an actual trip of the turbine. In this manner, the trip control system of U.S. Pat. No. 7,874,241 provides reliable trip operation by providing redundant block and bleed functionality in combination with enabling the individual components of the block and bleed circuits to be tested while the turbine is online and operating but without preventing the turbine from being tripped, if necessary, during the test.

While the trip control system disclosed in U.S. Pat. No. 7,874,241 overcomes some of the problems with known trip control systems, it still has some shortcomings. In particular, while the trip control system described in U.S. Pat. No. 7,874,241 can be used to detect faulty solenoids or valves within the bleed circuit while operating on-line, the faulty components of the bleed circuit cannot be repaired or replaced until the turbine system is shut down or otherwise put out of service, making repair of the faulty components harder to implement. Additionally, the trip control system of U.S. Pat. No. 7,874,241 provides pressure from a pressure line to the trip valves and to trip header lines via orifices which must be sized to provide sufficient pressure at the trip header line during normal operation of the turbine to prevent a trip, while being small enough not to bleed a lot of oil (or other hydraulic fluid) from the pressure line to the trip header line and then to the drain or tank when a trip has been engaged. The use and sizing of these orifices, and therefore the operation of these orifices, always involves a trade-off of performance when in the normal operating state versus the tripped state. Moreover, the trip control system described in U.S. Pat. No. 7,874,241 includes manifolds that require various oil lines to be coupled thereto with tubes and fittings, leading to a system that is harder to install and configure, as well as one that has a lot of failure points with respect to the oil supply.

SUMMARY

A trip control system for use with, for example, turbines, includes a porting manifold that supports and provides fluid to two or more trip manifolds, wherein each of the trip manifolds includes a bleed circuit having two or more bleed valves connected in parallel between a trip header line and a return or dump line to bleed the hydraulic fluid pressure from the trip header line to thereby cause a trip. The bleed valves of each of the tripping manifolds are actuated by one or more control valves under control of a process or safety controller which operates to cause a trip by first performing a bleed function using at least one of the bleed valves and then a block function using blocking valves mounted in a block circuit. Additionally, pressure sensors are disposed at various locations within each of the trip manifolds and these sensors provide feedback to the controller to enable the controller to test each of the bleed valves individually, during operation of the turbine, without causing an actual trip of the turbine. In this manner, the trip control system provides reliable trip operation by providing redundant bleed functionality in combination with enabling the individual components of the bleed circuits to be tested while the turbine is online and operating but without preventing the turbine from being tripped, if necessary, during the test. Moreover, because of the use of the porting manifold and multiple trip manifolds to implement the bleed circuit, one of the trip manifolds can be removed from or isolated from the trip control system using various valves during on-line operation of the turbine to enable replacement of the one of the trip manifolds and/or of any of the various components installed thereon while the other trip manifold continues to operate to control a trip, if needed. In this manner, the trip control system is doubly redundant in that the trip control system includes (1) redundant trip manifolds operating in parallel so that each of the trip manifolds is able to be used to independently engage a trip of the turbine, meaning that one of the trip manifolds can be isolated and removed or repaired while the other trip manifold continues to operate to force a trip of the turbine, if necessary and (2) each of the trip manifolds includes redundant sets of valves and other trip components that enable the trip manifold to operate to engage a trip of the turbine in the presence of a failure of one of the sets of components on a trip manifold, or while various components of the trip manifold are being tested.

Still further, a porting manifold for use in a trip control system for controlling the operation of a controlled device using system pressure delivered from a fluid pressure source to an input of the controlled device includes a first trip manifold having a first bleed trip circuit and a second trip manifold having a second bleed trip circuit. The porting manifold includes a first fluid channel for coupling to a system pressure line. The first fluid channel is disposed within the porting manifold and extends between a system pressure inlet port, a first system pressure outlet port, and a second system pressure outlet port, wherein the first system pressure outlet port facilitates hydraulic coupling of the first fluid channel to the first trip manifold and the second system pressure outlet port facilitates hydraulic coupling of the first fluid channel to the second trip manifold. Additionally, the porting manifold includes a second fluid channel for coupling to a system drain line. The second fluid channel is disposed within the porting manifold and extends between a system drain outlet port, a first system drain inlet port, and a second system drain inlet port, wherein the first system drain line inlet port facilitates hydraulic coupling of the second fluid channel to the first trip manifold and the second system drain line inlet port facilitates hydraulic coupling of the second fluid channel to the second trip manifold.

Still further, a redundant trip manifold system for use in a trip control system for controlling the operation of a controlled device using system pressure delivered from a fluid pressure source to an input of the controlled device includes a bleed circuit hydraulically coupled between a trip header line and a return line, wherein the bleed circuit hydraulically and controllably connects the trip header line to the return line to reduce the fluid pressure within the trip header line at the controlled device. The bleed circuit includes a porting manifold having a plurality of fluid channels disposed within the porting manifold. Each fluid channel includes an inlet port at a surface of the porting manifold and an outlet port at the surface of the porting manifold. Additionally, the bleed circuit includes a first and second trip manifold removably coupled to the porting manifold. The first trip manifold includes a first bleed system having a plurality of redundant valve systems creating redundant bleed fluid paths connected in parallel between the trip header line and the return line, and the second trip manifold includes a second bleed system having a plurality of redundant valve systems creating redundant bleed fluid paths connected in parallel between the trip header line and the return line, wherein the first and second bleed systems are hydraulically coupled to operate simultaneously and independently of one another to remove system pressure from one or both of the trip header lines.

Still further, a trip control system for controlling the operation of a controlled device using fluid pressure delivered from a fluid pressure source to an input of the controlled device includes a controller, a fluid pressure line adapted to be connected between the fluid pressure source and the controlled device, a low pressure fluid return line, a block circuit disposed at least partially in the fluid pressure line and coupled to the low pressure fluid return line, and a bleed circuit hydraulically coupled between a fluid pressure line and a low pressure fluid return line, wherein the bleed circuit hydraulically and controllably connects the fluid pressure line to the low pressure fluid return line to reduce the fluid pressure within the fluid pressure line at the controlled device. The bleed circuit includes a porting manifold having a plurality of fluid channels. Each fluid channel of the plurality of fluid channels extends through the porting manifold from a first port at a surface of the porting manifold to a second port at the surface of the porting manifold. A first trip manifold is removably coupled to the porting manifold and includes a first bleed system, and a second trip manifold is removably coupled to the porting manifold and includes a second bleed system, wherein the first and second bleed systems are hydraulically coupled to operate simultaneously and independently of one another to remove system pressure from one or both of the trip header lines.

Still further, a trip manifold system for use in a trip control system for controlling the operation of a controlled device using system pressure delivered from a fluid pressure source to an input of the controlled device includes a bleed circuit hydraulically coupled between a trip header line and a return line, wherein the bleed circuit hydraulically and controllably connects the trip header line to the return line through a plurality of trip branches to reduce the fluid pressure within the trip header line at the controlled device. The bleed circuit includes a plurality of control valve systems, wherein each control valve system include an actuator valve hydraulically and controllably coupled to the control input of a supply pressure cutoff valve and the control inputs of a pair of trip valves, wherein operation of two or more of the control valve systems causes at least one bleed path to be created between the trip header line and the return line, while operation of only one of the control valve systems does not create a bleed path between the trip header line and the return line.

Still further, the trip control system includes a separate valve located within each of the redundant paths of each of the trip manifolds that operates to fully connect the system pressure line to the trip header line when the system is in a non-tripped state and to fully disconnect the system pressure line from the trip header line when the system is in a tripped state. This configuration enables a full pressure connection between the pressure line and a trip header line during a non-tripped condition to minimize false or inadvertent trips due to an under pressure condition at the trip header line, while preventing excessive bleeding from the pressure line to the tank or bleed circuit via the trip header line during a tripped condition.

Still further, the bleed portion of the redundant trip control circuit can be integrated into a small, single package that can be easily fit onto existing turbine systems, and uses o-ring fittings at the port connecting various fluid lines in the manifolds to one another to minimize the need to install tubing between various ones of the trip system components. These features enable an existing turbine trip control system to be retrofit or upgraded relatively inexpensively.

Still further, a method for operating a controlled device using a redundant trip manifold system providing control pressure delivered from a system pressure source to an input of the controlled device in a manner that enables one of a pair of redundant trip manifolds to be removed from a porting manifold while the controlled device is operating without preventing a tripping action includes disconnecting a first redundant trip manifold from the system pressure source, disconnecting the first redundant trip manifold from the control pressure, disconnecting the first redundant trip manifold from a drain line, removing the first redundant trip manifold from the porting manifold, and continuing to operate the controlled device in a manner that does not prevent a tripping action on a second redundant trip manifold while the first redundant trip manifold is removed.

Still further, a method of operating a controlled device using a trip manifold to deliver control pressure from a system pressure source to an input of a controlled device includes receiving a trip signal from a controller and executing a tripping action of the trip manifold in response to receiving the trip signal from the controller. The tripping action includes de-energizing an actuator valve of a first control valve system to couple a control input of a control valve of the first control valve system to a drain line, wherein the control valve closes a first fluid path between the system pressure line and a control pressure line, de-energizing an actuator valve of a second control valve system to couple a control input of a control valve of the second control valve system to the drain line, wherein the control valve closes a second fluid path between the system pressure line and the control pressure line, and de-energizing an actuator valve of a third control valve system to couple a control input of a control valve of the third control valve system to the drain line, wherein the control valve closes a third fluid path between the system pressure line and the control pressure line, and wherein the control pressure line is sealed from the system pressure line by the control valves of the first, second and third control valve systems.

Still further, a method of testing the operation of a redundant trip manifold system delivering control pressure to an input of a controlled device from a system pressure source in a manner that enables one of a plurality of control valve systems to be tested without preventing a tripping action includes de-energizing an actuator valve of a first control valve system to couple a control input of a control valve of the first control valve system to a drain line, wherein the control valve closes a fluid path between the system pressure line and a control pressure line. The de-energized actuator valve of the first control valve system further causing a first trip valve of the first control valve system to be coupled to the drain line and a control input of a second trip valve of the first control valve system to be coupled to the drain line. The method includes monitoring pressure at an output of the first trip valve of the first control valve system and monitoring pressure at an input of the second trip valve of the first control valve system. The method further includes comparing the monitored pressure at the output of the first trip valve of the first control valve system to a first redundant trip valve outlet pressure level, comparing the monitored pressure at the input of the second trip valve of the first control valve system to a second redundant trip valve inlet pressure level, executing a first command indicating an operating condition of the first trip valve of the first control valve system based on the comparison of the monitored pressure at the output of the first trip valve of the first control valve system to the first redundant trip valve outlet pressure level; and executing a second command indicating an operating condition of the second trip valve of the first control valve system based on the comparison of the monitored pressure at the inlet of the second trip valve of the first control valve system to the first redundant trip valve inlet pressure level.

In further accordance with the inventive aspects described herein, any one or more of the foregoing embodiments may further include any one or more of the following forms.

In one form, an attachment mechanism attaches the first and/or second trip manifolds to the porting manifold. The attachment mechanism may include a bore for receiving a bolt to removably attach the first trip manifold or the second trip manifold to the porting manifold. The bore may further include a threaded portion.

In another form, a first valve may be mounted to the porting manifold and coupled to the first system pressure outlet port to open the first system pressure outlet port and hydraulically couple the first trip manifold to the first fluid channel or close the first system pressure outlet port and hydraulically isolate the trip manifold from the first fluid channel. The first valve may be a pin valve that is electronically or manually controllable.

In another form, a second valve may be mounted to the porting manifold and coupled to the second system pressure outlet port to open the second system pressure outlet port and hydraulically couple the second trip manifold to the first fluid channel or close the second system pressure outlet port to hydraulically isolate the second trip manifold from the second fluid channel. The second valve may be a pin valve that is electronically or manually controllable.

In another form, a first surface and/or side of the porting manifold includes the system pressure outlet port, the second system pressure outlet port, the first system drain inlet port, and the second system drain inlet port; a second surface and/or side of the porting manifold includes the system pressure inlet port and the system drain outlet port; and a third surface and/or side includes the first valve of the first and/or second set of valves.

In another form, a third valve may be mounted to the porting manifold and coupled to the first drain inlet port to open the first drain inlet port and hydraulically couple the first trip manifold to the second fluid channel or close the first drain inlet port to hydraulically isolate the first trip manifold from the second fluid channel. The third valve may be a pin valve that is electronically or manually controllable.

In another form, a fourth valve may be mounted to the porting manifold and coupled to the second drain inlet port to open the second drain inlet port and hydraulically couple the second trip manifold to the second fluid channel or close the second drain inlet port to hydraulically isolate the second trip manifold from the second fluid channel. The fourth valve may be a pin valve that is electronically or manually controllable.

In another form, the porting manifold includes a third fluid channel for coupling to a first trip header line. The third fluid channel is disposed within the porting manifold and extends between a first trip header inlet port and a first trip header outlet port, wherein the first trip header inlet port facilitates hydraulic coupling of the third fluid channel to the first trip manifold.

In another form, the porting manifold includes a fifth valve coupled to the first trip header inlet port that opens the first trip header inlet port to hydraulically couple the first trip manifold to the third fluid channel or closes the first trip header inlet port to hydraulically isolate the first trip manifold from the third fluid channel.

In another form, the porting manifold includes a fourth fluid channel for coupling to a second trip header line. The fourth fluid channel is disposed within the porting manifold and extends between a second trip header inlet port and a second trip header outlet port, wherein the second trip header inlet port facilitates hydraulic coupling of the fourth fluid channel to the second trip manifold.

In another form, the porting manifold includes a sixth valve coupled to the second trip header inlet port that opens the second trip header inlet port to hydraulically couple the second trip manifold to the fourth fluid channel or closes the second trip header inlet port to hydraulically isolate the second trip manifold from the fourth fluid channel.

In another form, the porting manifold includes a fifth fluid channel for coupling to a tank. The fifth fluid channel is disposed within the porting manifold and extends between a first tank inlet port and a first tank outlet port, wherein the first tank inlet port facilitates hydraulic coupling of the first trip manifold to the tank.

In another form, the porting manifold includes a seventh valve coupled to the first tank inlet port that opens the first tank inlet port to hydraulically couple the first trip manifold to the fifth fluid channel or closes the first tank inlet port to hydraulically isolate the first trip manifold from the fifth fluid channel.

In another form, the porting manifold includes a sixth fluid channel for coupling to the tank. The sixth fluid channel is disposed within the porting manifold and extends between a second tank inlet port and a second tank outlet port, wherein the second tank inlet port facilitates hydraulic coupling of the second trip manifold to the tank.

In another form, the porting manifold includes an eighth valve coupled to the second tank inlet port that opens the second tank inlet port to hydraulically couple the second trip manifold to the sixth fluid channel or closes the second tank inlet port to hydraulically isolate the second trip manifold from the sixth fluid channel.

In another form, the first and/or second bleed system of the trip manifold system, or a redundant trip manifold system, includes a first, second, and third valve system. Each of the first, second, and third valve systems of the bleed system includes an actuator valve to operate two trip valves and a supply pressure cutoff valve, wherein operation of two or more of the first, second, and third valve systems of the bleed system causes at least one bleed fluid path to be created between the fluid pressure line and the low pressure fluid return line, while operation of only one of the valve systems of the first bleed system does not create a bleed fluid path between the fluid pressure line and the low pressure fluid return line.

In another form, a bleed path includes an open pair of trip valves within a trip branch.

In another form, a pressure transmitter is operatively coupled between a pair of trip valves within a trip branch, in particular, between the outlet port of the first trip valve and the inlet port of the second trip valve.

In another form, a pressure reduction orifice is operatively coupled between an outlet port of the first trip valve of a trip branch, an inlet port of the second trip valve of the trip branch, and the trip header line.

In another form, a first pressure reduction orifice is operatively coupled between an outlet port of the first trip valve of a trip branch, an inlet port of the second trip valve of the trip branch, and the drain line.

In another form, a take-off port is operatively coupled to the control input of the trip valve to facilitate connection with a controlling and/or monitoring device.

In another form, the flow path through the trip valve is larger than a flow path through the supply pressure cutoff valve.

DETAILED DESCRIPTION

Figure 1:
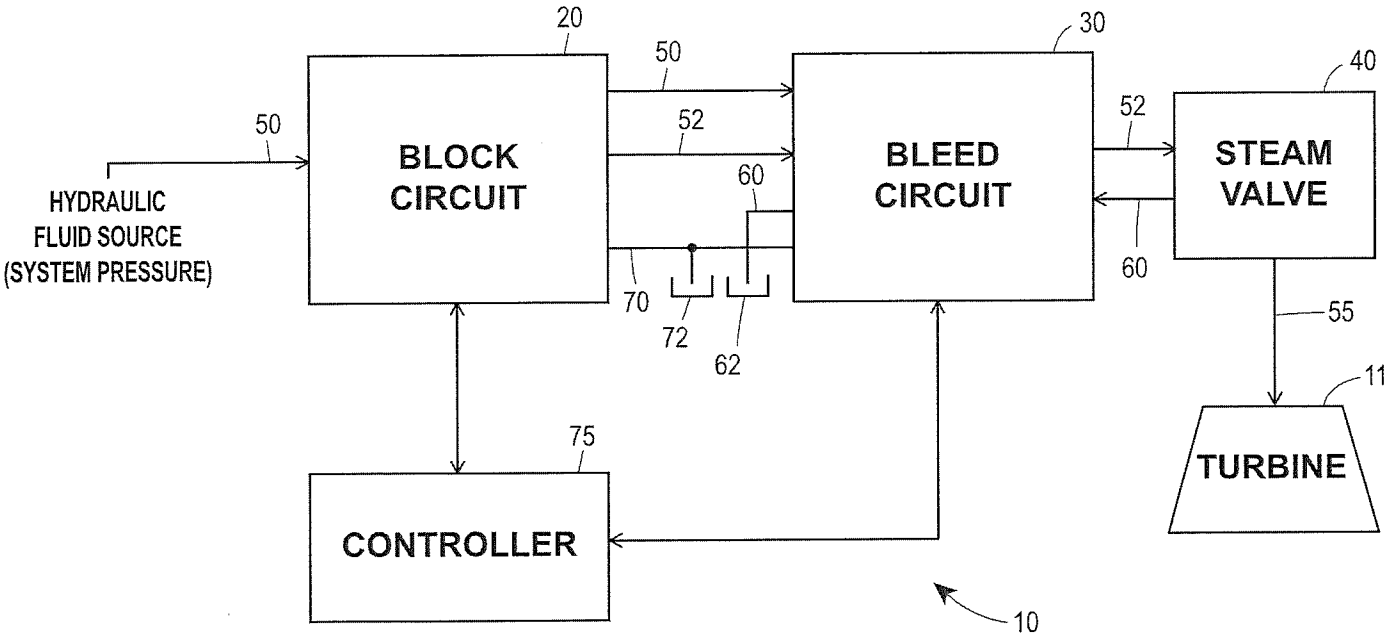
FIG. 1 is a functional block diagram of an embodiment of a hydraulic control system for a turbine including a bleed circuit and a block circuit.

Referring to FIG. 1, a trip control system 10 for use with a turbine 11 includes a block circuit 20 that provides internally (automatically) actuated and testable block functionality in combination with a bleed circuit 30 that provides redundant electronically actuated and testable bleed functionality and which, together, control the operation of a steam valve 40 to provide reliable trip operation for the turbine 11 during a safety trip and in a manner that enables components of the system to be repaired or replaced while the trip control system 10 and/or the turbine 11 are operating.

Generally speaking, the block circuit 20 and the bleed circuit 30 include redundant blocking and redundant bleed functionality that enables the components of the block circuit 20 and the bleed circuit 30 to be tested and replaced while the turbine 11 is online and operating and in a manner that does not prevent a tripping action during the testing or replacement of any of the components of the block circuit 20 or the bleed circuit 30. Furthermore, the block circuit 20 and/or the bleed circuit 30 can be integrated into a small, single package that can be easily fit onto existing turbine trip control systems to enable such existing systems to be retrofit with the enhanced redundant, testable and replaceable bleed functionality described herein.

As will be understood from FIG. 1, a line 50 supplies hydraulic fluid at system pressure from a fluid or pressure source (not shown) through the block circuit 20 and then to the bleed circuit 30 to generally provide control pressure to individual valves within these circuits as well as to charge a trip header line. More particularly, the line 50 is connected to the hydraulic fluid source upstream of the block circuit 20, and the fluid source supplies hydraulic fluid at system pressure to the line 50 both upstream and downstream of the block circuit 20. Hydraulic fluid is also provided at or slightly below system pressure in one or more lines 52 (referred to herein as trip headers or trip header lines) downstream of the block circuit 20 depending on the operation of the block circuit 20. The line or lines 52 are used in the bleed circuit 30 and are connected to a control input (also referred to herein as a trip input) of the steam valve 40 to control the operation of the steam valve 40. Generally speaking, pressure over a certain amount within the trip header line 52 at the input of the steam valve 40 causes the steam valve 40 to remain open, which allows steam to enter the turbine 11 via the line 55 thereby allowing or causing operation of the turbine 11. Additionally, a return hydraulic or pressure line 60, which is a low pressure fluid line, is coupled from the steam valve 40 through the bleed circuit 30 to a return reservoir 62 (also called a tank) while a drain line 70, which is also a low pressure fluid line, connects the bleed circuit 30 and the block circuit 20 to a hydraulic fluid drain 72. If desired, the fluid drain 72 and the return reservoir or tank 62 may be the same reservoir, and thus the low pressure fluid lines 60 and 70 may be hydraulically coupled together via the tank 62 or otherwise.

As illustrated in FIG. 1, a controller 75, which may be a safety controller, a process controller or any other desired type of controller and which may be implemented using distributed control system DSC technology, PLC technology, or any other type of control technology, is operatively coupled to each of the block circuit 20 and the bleed circuit 30. During operation, the controller 75 is configured to automatically operate the bleed circuit 30 which removes pressure from the trip header line(s) 52 causing a trip of the turbine 11 and causing the block circuit 20 to close automatically due to the loss of pressure in the passage from the trip pressure line 52. Additionally, the controller 75 is configured to receive pressure measurements from the block circuit 20 and the bleed circuit 30, which enables the controller 75 to perform tests of the individual components of the block circuit 20 and the bleed circuit 30 to thereby test the operation of the components of these circuits. However, as will be understood from the discussion below, the block circuit 20 and the bleed circuit 30 are configured to operate to be able to perform a trip both while these circuits are being tested as well as while individual components of at least the bleed circuit 30 are being repaired or replaced. This functionality enables repair and replacement of components during operation of the turbine 11, while in the past repair (at least of the bleed circuit 30) could only be performed when the turbine 11 was shut down.

It should be understood that the controller 75 may be remote from or local to the block circuit 20 and the bleed circuit 30. Furthermore, the controller 75 may include a single control unit that operates and tests the block circuit 20 and the bleed circuit 30 or multiple control units, such as distributed control units, which are each configured to operate different ones of the block circuit 20 and the bleed circuit 30. Generally speaking, the structure and configuration of the controller 75 are conventional and, therefore, are not discussed further herein.

During normal operation of the turbine 11, which may be configured to drive a generator, for example, hydraulic fluid under pressure (e.g., operating oil) is supplied from a hydraulic fluid source (e.g., a pump) to the block circuit 20 and the bleed circuit 30 via the line 50, and to the steam valve 40 via the hydraulic fluid path made up of the trip header line or lines 52 which are coupled to the line 50 as described in more detail herein. The hydraulic fluid may include any suitable type of hydraulic material that is capable of flowing along the hydraulic fluid paths 50 and 52 as well as the return path 60 and drain line 70. As noted above, when the pressure in the fluid line(s) 52 at the trip input to the steam valve 40 is at a predetermined system pressure, the steam valve 40 allows or enables the flow of steam to the turbine 11. However, when the pressure in the fluid line(s) 52 at the trip input of the steam valve 40 drops to a predetermined amount or a significant amount below system pressure or trip header pressure (which is typically slightly less than system pressure), the steam valve 40 closes or trips, which causes a shutdown of the turbine 11.

Generally speaking, to cause a trip of the turbine 11, the controller 75 first operates the bleed circuit 30 to bleed fluid from one or more of the trip header line(s) 52 at the trip input of the steam valve 40 to the return line 60 and then to the tank 62 to thereby remove the system pressure from the trip input of the steam valve 40 and cause a trip of the turbine 11. Once a trip of the turbine 11 has occurred, the block circuit 20 automatically operates due to the loss of trip pressure in the line 52 to block the flow of hydraulic fluid within the line(s) 52 to prevent continuous supply of hydraulic fluid from the supply line 50 to the line(s) 52 while the turbine 11 is in a trip state. Additionally, as will be discussed in more detail, the controller 75 may control various components of the bleed circuit 30 and the block circuit 20 during normal operation of the turbine 11 to test those components without causing a trip of the turbine 11. This testing functionality enables the components of the trip system 10 to be periodically tested, and replaced if necessary, during operation of the turbine 11 without requiring the turbine 11 to be shut down or taken off line either during the testing activities or the repair and replacement activities. This testing functionality also enables failed components of the block and bleed circuits 20 and 30 to be detected and replaced or repaired prior to the actual operation of a trip, thereby helping to assure reliable trip operation when needed. As will also be described in more detail, the bleed circuit 30 is configured to enable components of this circuit to be repaired or replaced during operation of the turbine without affecting the ability of the controller 75 to cause a trip of the turbine 11 via the steam valve 40.

In one embodiment, the controller 75 operates the bleed circuit 30 to perform a trip of the turbine 11 in response to the detection of one or more abnormal conditions or malfunctions within the plant in which the turbine 11 is located. To help ensure that a trip operation is performed even if one or more components associated with the bleed circuit 30 fails to operate properly or while components of the bleed circuit 30 are being repaired or replaced, the bleed circuit 30 preferably includes a plurality, e.g., two, bleed systems that operate simultaneously and in parallel to one another.

Moreover, each of the bleed systems within the bleed circuit 30 preferably includes a plurality of redundant valve systems that create redundant bleed fluid paths connected in parallel between the trip header line(s) 52 and the return line 60, wherein operation of any one of the parallel bleed fluid paths is sufficient to remove trip header pressure from the trip input of the steam valve 40 and thereby cause a trip of the turbine 11. In one embodiment, each bleed system of the bleed circuit 30 may include three such valve systems, and each of the valve systems may include an actuator valve that controls two trip valves and a supply pressure cutoff valve. In this case, as will be described in more detail, operation of two or more of the valve systems of either of the bleed systems causes at least one bleed fluid path to be created between one of the lines 52 and the return line 60, while operation of only one of the valve systems of either of the bleed systems does not create a bleed path between the lines 52 and the return path 60. This configuration is known as a two out of three voting system, and assures that a malfunction of a single one of the valve systems of either of the bleed systems cannot cause a trip when the controller 75 is not trying to initiate a trip, while also assuring that a malfunction of a single one of the valve systems in each of the bleed systems will not prevent a trip from occurring when the controller 75 is trying to initiate a trip.

Figure 2:
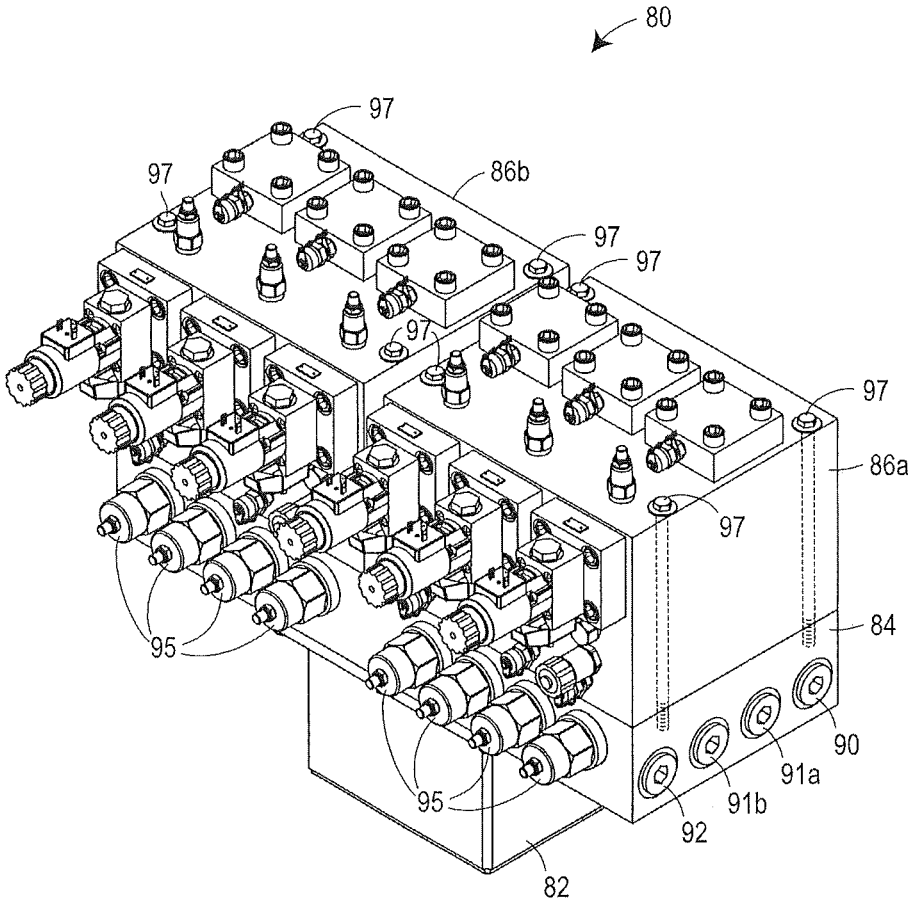
FIG. 2 is a perspective view of one embodiment of a bleed circuit of a hydraulic trip control system having redundant electronically testable trip circuits on multiple trip manifolds.

FIG. 2 illustrates a perspective view of an embodiment of a hydraulic bleed circuit 80 that may be used as the bleed circuit 30 of FIG. 1. The hydraulic bleed circuit 80 of FIG. 2 includes a tank 82 (which may be the tank 62 of FIG. 1), a porting manifold 84 and two trip manifolds 86*a* and 86*b* (also referred to as bleed trip manifolds) having various components mounted thereon. As will be understood, each of the bleed trip manifolds 86*a* and 86*b* includes valves, transmitters (or sensors), fluid paths and control lines needed to implement the bleeding operations described below with respect to a bleed system, and the bleed trip circuits implemented by the trip manifolds 86 and 86*b* operate independently and simultaneously to perform bleeding functions that initiate or prevent a trip of the steam valve 40 of FIG. 1. As illustrated in FIG. 2, the trip manifolds 86*a* and 86*b* are mounted onto and mate with the porting manifold 84 to establish various fluid paths between the trip manifolds 86*a* and 86*b*, the porting manifold 84 and the tank 82 (which is mounted on the opposite side of the porting manifold 84 than the trip manifolds 86*a* and 86*b*). In particular, a pressurized fluid line, one or more trip header lines, a return or tank line and a drain line are disposed within the porting manifold 84 and are coupled to the bleed trip manifolds 86*a* and 86*b* and in some cases to the tank 82. The bleed circuit implemented by each of the bleed trip manifolds 86*a* and 86*b* operates independently, but at the same time, to remove system pressure (or near system pressure) from one or both of the trip header lines 52 in response to the controller 75 (not shown in FIG. 2) to thereby cause a trip of the turbine 11 of FIG. 1. However, as will be described in more detail below, one of the trip manifolds 86*a* or 86*b* may be removed from the porting manifold 84 while the other trip manifold 86*a* or 86*b* continues to operate so as to allow parts of the trip circuits implemented on the trip manifolds 86*a*, 86*b* to be repaired or replaced while the turbine 11 is on-line and without negating the ability of the controller 75 to initiate a trip during this repair or replacement activity.

As illustrated in FIG. 2, the porting manifold 84 includes fluid input and output ports 90, 91*a*, 91*b* and 92 in the form of a system pressure input port 90, two trip header output ports 91*a*, 91*b* and a drain line output port 92. The porting manifold 84 also includes tank ports on the top and bottom thereof (not shown in FIG. 2). Additionally, in the embodiment of FIG. 2, eight mechanically or manually actuated valves 95, for example, pin valves, are disposed on one side of the porting manifold 84 and various ones of the valves 95 are fluidly connected to and operable to close off one of a set of fluid lines within the porting manifold 84 connected between the ports 90-92, the various ports of one of the trip manifolds 86*a* and 86*b* or fluid lines connected between the trip manifolds 86*a* and 86*b* and the tank 82. Likewise, as can be seen in FIG. 2, bolts 97 extend through the trip manifolds 86*a* and 86*b* and operate to secure the trip manifolds 86*a* and 86*b* to the porting manifold 84 via threaded engagement with the porting manifold 84.

Figure 3:
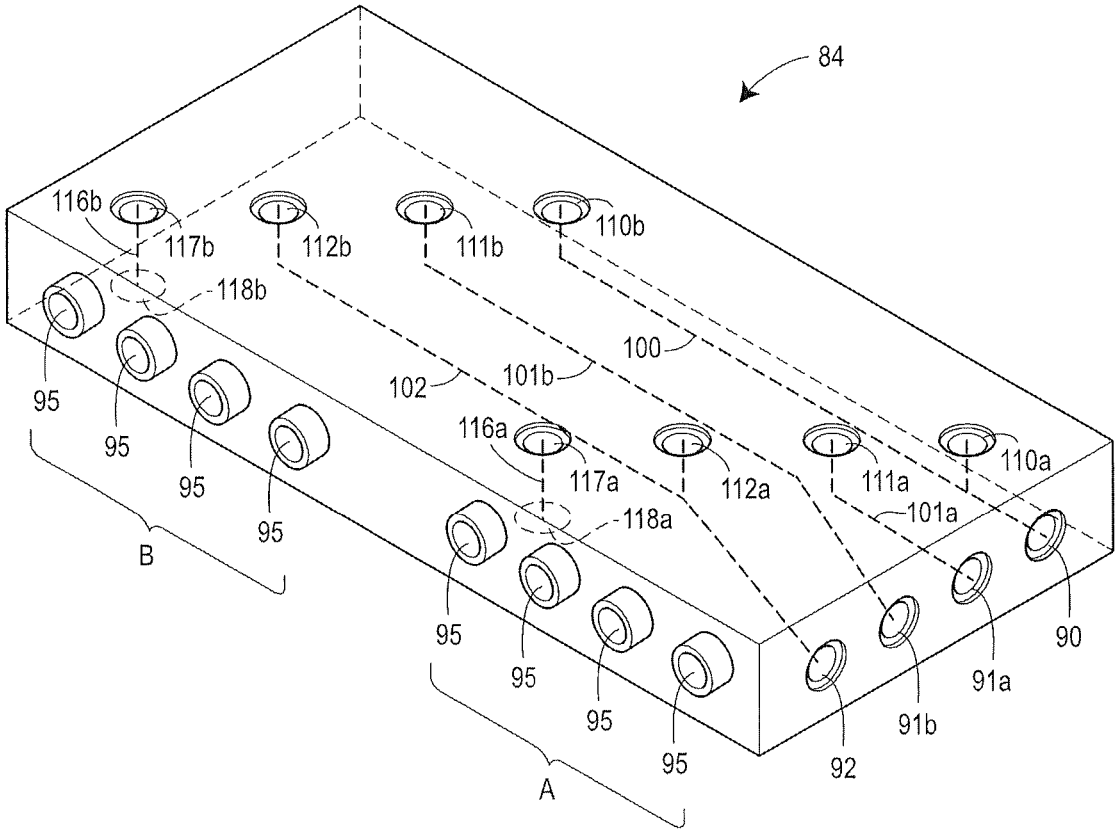
FIG. 3 is a perspective view of a porting manifold illustrated in FIG. 2.

FIG. 3 illustrates an expanded view of the porting manifold 84 of FIG. 2 with the trip manifolds 86*a* and 86*b* and the tank 82 removed. As illustrated in dotted relief in FIG. 3, the porting manifold 84 includes a set of fluid channels or lines (i.e., fluid paths) disposed therein generally connecting the ports 90-92 and various other ports disposed in the top and the bottom of the porting manifold 84 as illustrated in FIG. 3 with one another. In particular, a fluid channel 100 is disposed between the system pressure inlet port 90 and two system pressure outlet ports 110*a* and 110*b* and this fluid channel 100 may be the system pressure fluid line 50 of FIG. 1. Likewise, a fluid channel 101*a* is disposed between the trip header outlet port 91*a* and a trip header inlet port 111*a* while a fluid channel 101*b* is disposed between the trip header outlet port 91*b* and a trip header inlet port 111*b*. The channels 101*a* and 101*b* may implement the trip header fluid lines 52 (also referred to herein as lines 52*a* and 52*b*) of FIG. 1. A fluid channel 102 is disposed between the drain line output port 92 and drain line inlet ports 112*a* and 112*b* and may used to implement the drain line 70 of FIG. 1. Still further, tank fluid lines 116*a* and 116*b* are connected between tank inlet ports 117*a* and 117*b* disposed in the top of the porting manifold 84, and tank outlet ports 118*a* and 118*b* disposed in the bottom of the porting manifold 84, respectively. Moreover, as illustrated schematically in FIG. 3, various different ones of the pin valves 95 are mounted on the side of the porting manifold 84 and operate to connect or isolate various different ones of the ports 110, 111, 112, and 117 from the fluid channels 100, 101, 102 and 116. As will be understood, a first set of four pin valves 95 labeled as A in FIG. 3 are associated with the ports 110*a*, 111*a*, 112*a*, and 117*a* which mate with ports on the first trip manifold 86*a* (not shown in FIG. 3) while a second set of four pin valves 95 labeled as B in FIG. 3 are associated with the ports 110*b*, 111*b*, 112*b*, and 117*b* which mate with ports on the second trip manifold 86*b* (not shown in FIG. 3). While the pin valves 95 are described herein as being manually actuated valves, these valves could be other types of valves or fluid switches that are manually or electronically controlled in any desired manner and that operate to close or isolate the ports on the porting manifold that connect the trip manifolds 86*a* and 86*b* to the rest of the trip circuit.

Figure 4:
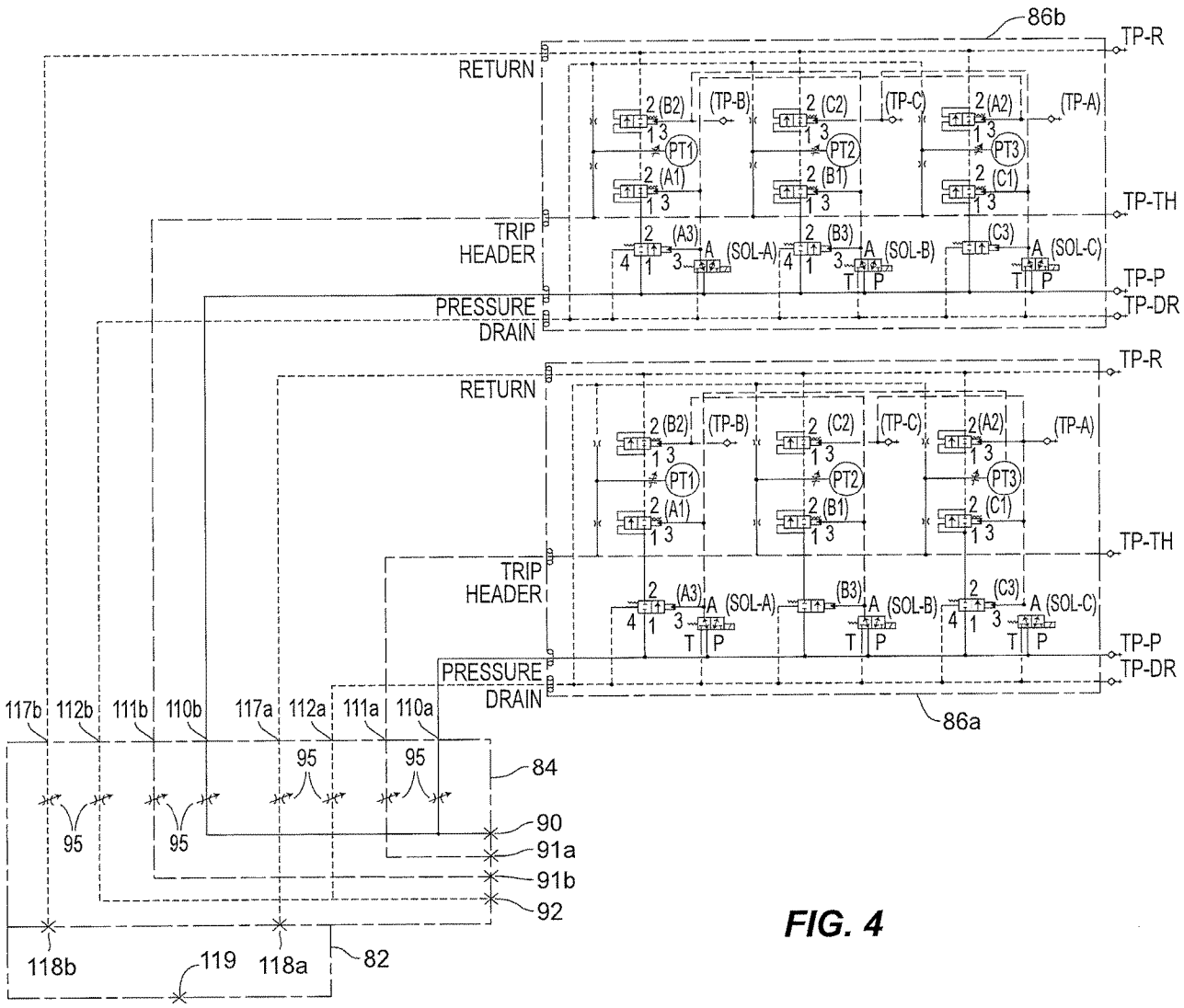
FIG. 4 is a flow circuit diagram of the bleed circuit for the bleed circuit of the hydraulic trip control system of FIGS. 1 and 2 including the porting manifold of FIGS. 2 and 3 and the electronically testable trip manifolds of FIG. 2.

FIG. 4 illustrates a functional schematic diagram of the tank 82, and the control elements disposed on the porting manifold 84 and on the trip manifolds 86*a* and 86*b* when the trip manifolds 86*a* and 86*b* on the one hand and the tank 82 on the other hand are mounted onto the opposite sides the porting manifold 84 (illustrated in FIG. 3). As will be seen, when mounted together in this manner, the fluid lines 100, 101*a*, 101*b*, 102, 116*a* and 116*b* extend through the porting manifold 84 as described with respect to FIG. 3 and are connected to various fluid lines in the trip manifolds 86*a* and 86*b*. As illustrated in FIG. 4, the tank 82 includes a tank outlet port 119 that may be fluidly connected to a return or low pressure oil sump or reservoir via, for example a hose connection. As also illustrated in FIG. 4, a separate one of the pin valves 95 is connected in each of the fluid lines 100, 101*a*, 101*b*, 102, 116*a* and 116*b* and is operable to cut off or allow flow in the respective fluid line 100, 101*a*, 101*b*, 102, 116*a* and 116*b* from one port to another to thereby either isolate or connect the ports 90, 91*a*, 91*b*, 92, 118*a* and 118*b* from the various ports on the trip manifolds 86*a* and 86*b*. As will be understood, the pin valves 95 may generally be two position (open or close) type valves that allow full flow through a fluid channel or that seal the channel in which the pin valve is installed. However, other types of valves may be used instead, including valves that are controllable to be disposed over a range of positions between a fully open position and a fully closed position.

Figure 5:
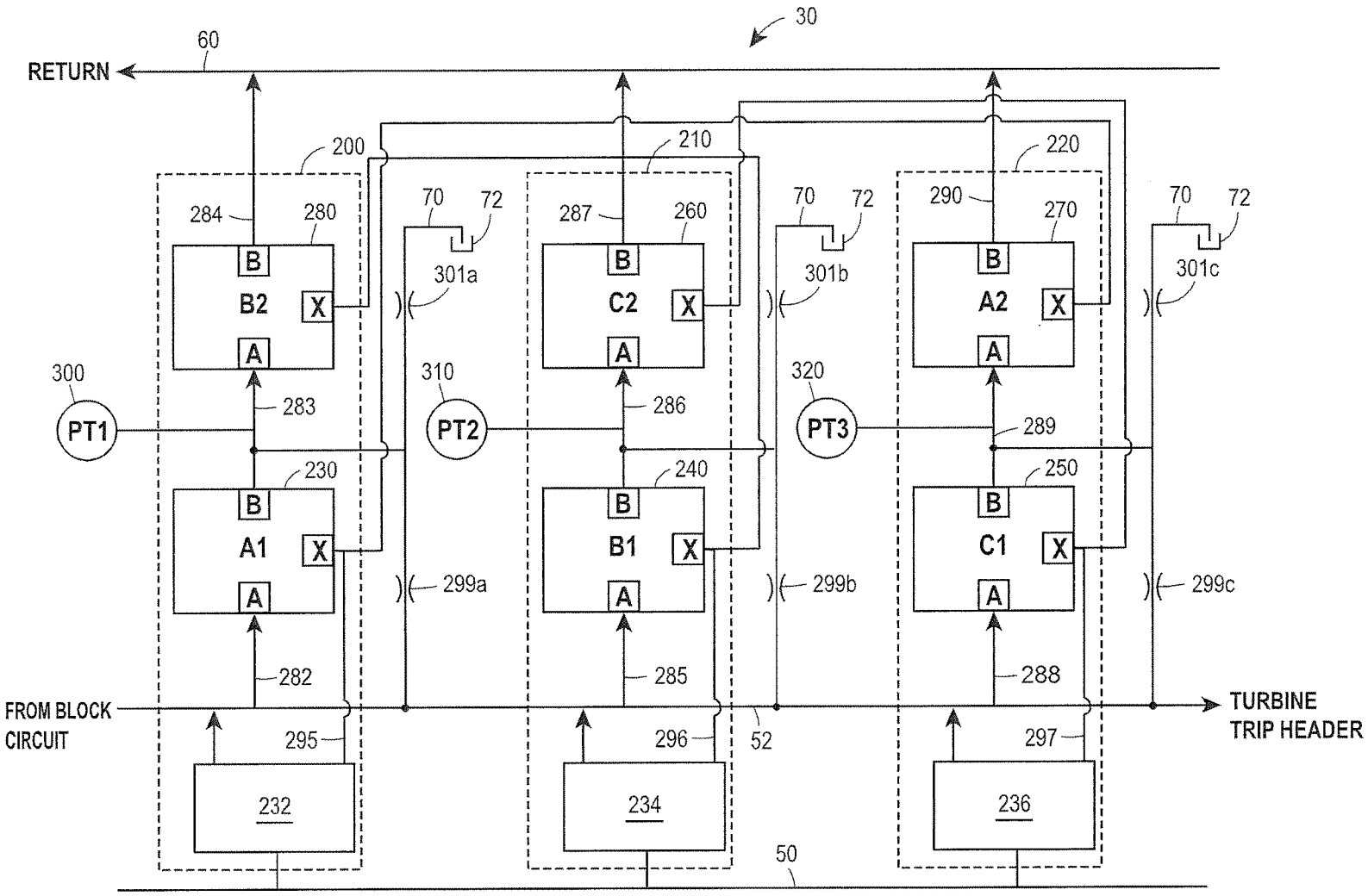
FIG. 5 is a functional block diagram of an embodiment of a bleed circuit disposed on one of the trip manifolds of FIGS. 2 and 4.

FIG. 5 illustrates a general operational diagram of one of the bleed systems disposed on one of the trip manifolds 86*a* or 86*b* of FIG. 4 disposed within and on one of the trip manifolds 86*a* or 86*b* in more detail, it being understood that the other bleed system disposed on the other trip manifold 86*a* or 86*b* is similar in construction and operation. In particular, the portion of the bleed circuit 30 disposed on the trip manifold 86*a* or 86*b* includes a plurality of redundant trip branches 200, 210 and 220 through which hydraulic fluid may flow from the system pressure line 50 to the pressure trip header line 52 and from the trip header line 52 to the return path 60 during a trip operation, thereby removing or bleeding pressure from the line 52 at the trip input of the steam valve 40 to stop operation of the turbine 11. As indicated in FIG. 5, each of the trip branches 200-220 includes a control valve system (e.g., one of valve systems 232, 234, or 236) and two trip valves (e.g., trip valves 230 and 280, 240 and 260, or 250 and 270). When two or more of the control valve systems 232, 234 and 236 are operating, and both trip valves of a single trip branch are open, a bleed path is created between trip header line 52 and the return path 60, and hydraulic fluid is thereby permitted to flow from the trip header 52 to the return path 60, which reduces the pressure in the trip header line 52. However, when either of the two valves of a single branch 200-220 is closed, hydraulic fluid is blocked or prevented from flowing from the trip header line 52 to the return line 60 through that branch. If all branches are blocked, then the pressure in the trip header line 52 remains at or near system pressure which keeps the steam valve 40 (FIG. 1) open and allows the turbine 11 to continue to run.

As can be seen from FIG. 5, the plurality of trip valves 230-280 includes a first trip valve (A1) 230, a second trip valve (B1) 240, a third trip valve (C1) 250, a fourth trip valve (C2) 260, a fifth trip valve (A2) 270, and a sixth trip valve (B2) 280. In one embodiment, each of the first through sixth trip valves 230-280 may be a two-way DIN cartridge valve having a pair of operational ports (A, B) and a control port (X) in which the operational ports (A, B) may be normally biased in an open position (i.e., in which fluid flow between the two ports is allowed) by a spring or other mechanical device (not shown). In the biased position, hydraulic fluid may pass through or between the operational ports (A, B) of the trip valves 230-280 and thus the valves 230-280 will open in response to the loss of control pressure at the control port (X). DIN cartridge valves are well known in the art and are, therefore, not described in further detail herein. As will be understood, when any of the trip valves 230-280 is in the open position, hydraulic fluid may flow from port A to port B of that valve. To the contrary, when control pressure is applied at the control port (X) of any of the trip valves 230-280, the trip valves 230-280 to which control pressure is provided locks the valve in a closed position to thereby block or prevent the flow of hydraulic fluid between the operational ports (A, B) of that valve. As will be described in more detail below, the control valve systems 232, 234, or 236 operate to control the flow of fluid from the system pressure line 50 to the trip header line 52 in each of the branches 200-220 as well as to control the flow of fluid from the system pressure line 50 to the control inputs (X) of the valves 230-280 to thereby control operation of the a trip valves 230-280.

As illustrated in FIG. 5, the first trip branch 200 includes the first trip valve (A1) 230 and the sixth trip valve (B2) 280 coupled between the hydraulic fluid path 52 (i.e., the trip header line) and the return path 60. Specifically, port A of the first trip valve (A1) 230 is hydraulically coupled to the hydraulic fluid path 52 via a hydraulic conduit 282, port B of the first trip valve (A1) 230 is hydraulically coupled to port A of the sixth trip valve (B2) 280 via hydraulic conduit 283, and port B of the sixth trip valve (B2) 280 is hydraulically coupled to the return path 60 via a hydraulic conduit 284.

As is evident in FIG. 5, the second trip branch 210 includes the second trip valve (B1) 240 and the fourth trip valve (C2) 260 coupled between the hydraulic fluid path 52 (i.e., the trip header line) and the return path 60. Specifically, port A of the second trip valve (B1) 240 is hydraulically coupled to the hydraulic fluid path 52 via a hydraulic conduit 285, port B of the second trip valve (B1) 240 is hydraulically coupled to port A of the fourth trip valve (C2) 260 via a hydraulic conduit 286, and port B of the fourth trip valve (C2) 260 is hydraulically coupled to the return path 60 via a hydraulic conduit 287.

Still further, the third trip branch 220 includes the third trip valve (C1) 250 and the fifth trip valve (A2) 270 coupled between the hydraulic fluid path 52 and the return path 60.

Specifically, port A of the third trip valve (C1) 250 is hydraulically coupled to the hydraulic fluid path 52 via a hydraulic conduit 288, port B of the third trip valve (C1) 250 is hydraulically coupled to port A of the fifth trip valve (A2) 270 via a hydraulic conduit 289, and port B of the fifth trip valve (A2) 270 is hydraulically coupled to the return path 60 via a hydraulic conduit 290.

For the sake of illustration, the control valves that make up the control valve systems 232, 234 and 236 which operate to control the operation of the trip valves 230-280 are not depicted in FIG. 5. However, as illustrated in FIG. 5, each control valve system 232, 234, 236 is coupled between the system pressure line 50 and the trip header line 52 and each control valve system 232, 234, 236 is connected to control the operation of two different trip valves in different ones of the trip branches 200-220. Thus, as illustrated in FIG. 5, the first control valve system 232 is connected to the control input (X) of the trip valve 230 (in the first trip branch 200) and to the control input (X) of the fifth trip valve 270 (in the third trip branch 220). Likewise, the second control valve system 234 is connected to the control input (X) of the trip valve 240 (in the second trip branch 210) and to the control input (X) of the sixth trip valve 280 (in the first trip branch 200) while the third control valve system 236 is connected to the control input (X) of the third trip valve 250 (in the third trip branch 220) and to the control input (X) of the fourth trip valve 260 (in the second trip branch 210).

As will be described in more detail with respect to FIG. 6, one or more control valves or actuators within the control valve systems 232, 234, 236 control the operation of each of a pair of the trip valves 230-280. More particularly, a first actuator in the valve system 232 simultaneously controls the operation of the valves A1 and A2 (230, 270), a second actuator in the valve system 234 simultaneously controls the operation of the trip valves B1 and B2 (240, 280), and a third actuator in the valve system 236 simultaneously controls the operation of the trip valves C1 and C2 (250, 260).

Figure 6:
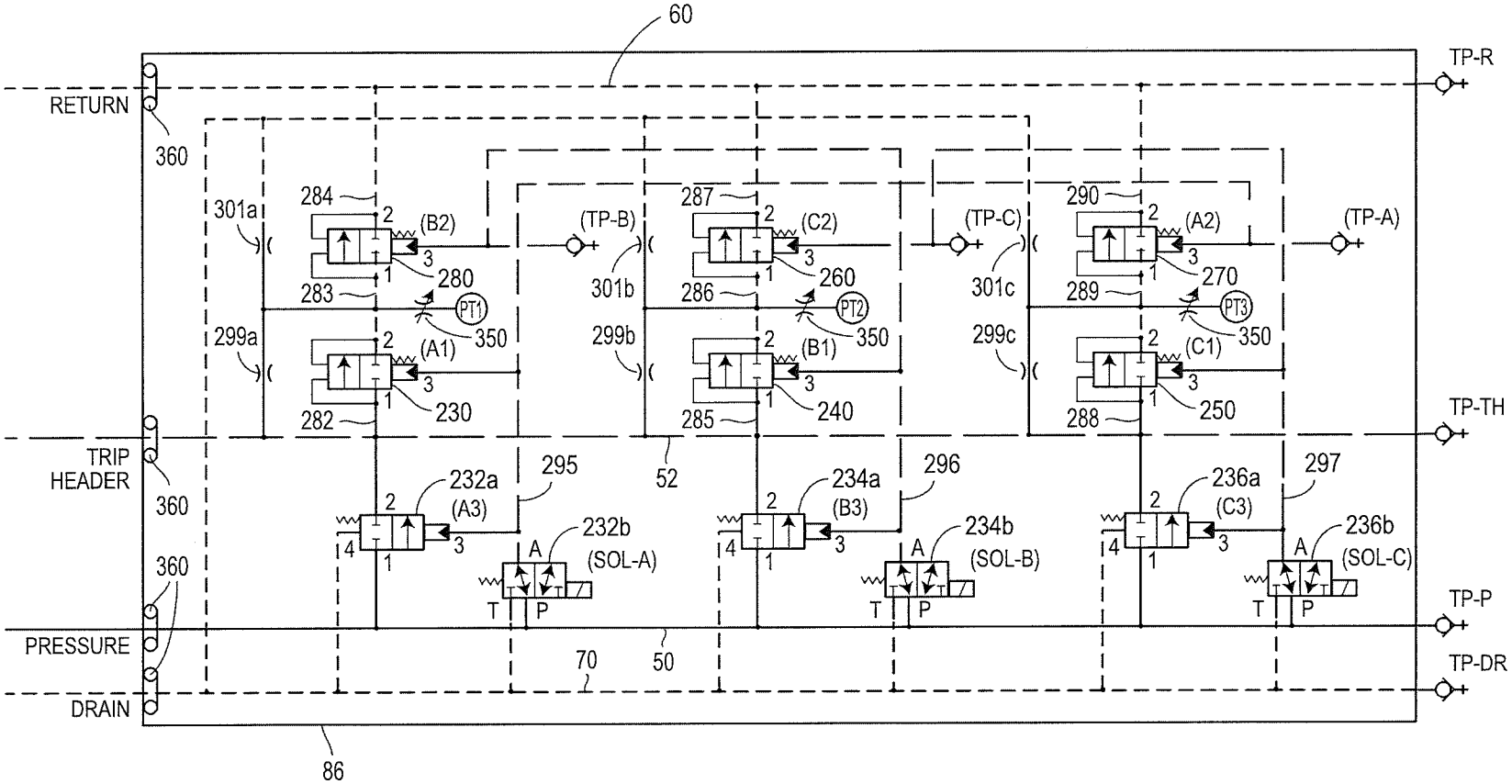
FIG. 6 is a more detailed schematic diagram of the bleed circuit components on one of the trip manifolds of FIGS. 2 and 4.

FIG. 6 illustrates an example schematic diagram depicting one manner of implementing the bleed circuit depicted in FIG. 5 in which the first through sixth trip valves (A1, A2, B1, B2, C1, C2) 230-280 are connected between the hydraulic fluid line 52 and the return line 60. In addition, each of the valve systems 232, 234, 236 is illustrated as including two control valves 232*a*, 232*b*, or 234*a*, 234*b*, or 236*a*, 236*b* with the control valves 232*a*, 234*a*, 236*a* being labeled as A3, B3 and C3, respectively. In addition, each of the valves 232*b*, 234*b*, 236*b* is an electronically controlled solenoid valve that is coupled to and controlled by the controller 75 of FIG. 1. These solenoid valves are also labeled as SOL-A, SOL-B, SOL-C in FIG. 6. During operation, when a solenoid valve 232*b*, 234*b* or 236*b* is energized, the solenoid valve 232*b*, 234*b*, 236*b* opens to connect the system pressure line 50 to the control inputs of two of the trip valves, as described with respect to FIG. 5 and to provide system pressure to the control input (3) of the other control valve 232*a*, 234*a* or 236*a*. When energized (i.e., when system pressure is applied to the control input 3), the control valve 232*a*, 234*a* or 236*a* opens to provide a connection between the system pressure line 50 and the trip header line 52 to thereby establish trip header pressure at the trip header line 52. Generally speaking, the valve systems 232, 234, 236 are configured to be fail safe, so that the controller 75 must energize the solenoid valves 232*b*, 234*b*, 236*b*, to cause the system pressure line 50 to be fluidly connected to the trip header line 52 and to cause the pairs of trip valves A1, A2 or B1, B2, or C1, C2 (controlled by the solenoid valves 232*b*, 234*b*, 236*b*) to be closed to block the bleed paths between the trip header line 52 and the return line 60. In this case, loss of electronic control of a solenoid valve 232*b*, 234*b*, or 236*b* will result in the closure of the associated control valve 232*a*, 234*a* or 236*a* (and thus the disconnection of one of the paths from the system pressure line 50 to the trip header line 52) as well as opening of the trip valves having control inputs connected to the solenoid valve (which may open a bleed path from the trip header line 52 to the return line 60).

Again, as illustrated in FIG. 6, the first solenoid actuator 232*b* within the valve system 232 is operatively coupled to a control port (3) of both the first trip valve (A1) 230 and the fifth trip valve (A2) 270 via hydraulic conduit 295 and simultaneously controls the application of control pressure at the control port (3) of both the first trip valve (A1) 230 and the fifth trip valve (A2) 270. When energized, the first actuator 232*b* is configured to activate both the first trip valve (A1) 230 and the fifth trip valve (A2) 270 to lock the first and fifth trip valves 230, 240 in their closed position. Simultaneously, the actuator 232*b* provides control pressure to control valve 232*a* (A3) to open the control valve 232*a* and provide a first fluid connection between the system pressure line 50 and the trip header line 52. Similarly, the second actuator 234*b* is operatively coupled to a control port (3) of both the second trip valve (B1) 240 and the sixth trip valve (B2) 280 via hydraulic conduit 296 and controls the application of control pressure at the control port (3) of both the second trip valve (B1) 250 and the sixth trip valve (B2) 280. Thus, when energized, the second actuator 232 *b* is configured to activate both the second trip valve (B1) 240 and the sixth trip valve (B2) 280 to lock the second and third trip valves 240, 280 in their closed position. Simultaneously, the actuator 234*b* provides control pressure to control valve 234*a* (B3) to open the control valve 234*a* and provide second a fluid connection between the system pressure line 50 and the trip header line 52. Still further, the third actuator 236*b* is operatively coupled to a control port (3) of both the third trip valve (C1) 250 and the fourth trip valve (C2) 260 via hydraulic conduit 297 and controls the application of control pressure at the control port (3) of both the third trip valve (C1) 250 and the fourth trip valve (C2) 260. When energized, the third actuator 236*b* is thus configured to activate both the third trip valve (C1) 250 and the fourth trip valve (C2) 260 to lock the third and the fourth trip valves 250, 260 in their closed position. Simultaneously, the actuator 236*b* provides control pressure to control valve 236*a* (C3) to open the control valve 236*a* and provide a third fluid connection between the system pressure line 50 and the trip header line 52. The flow paths through the trip valves 230 to 280 may be sized to be larger than the flow paths through or between the inputs (1) and (2) of the control valves 232*a*, 234*a* and 236*a* to assure that any one bleed path can bleed trip header pressure from the line 52 even if two or more of the control valves 232*a*, 234*a* and 236*a* is open.

As will be understood, each of the first, second, and third actuators 232*b*, 234*b*, 236*b* is operatively coupled to the controller 75, which is configured to energize and de-energize each of the first, second, and third actuators 232,*b*, 234*b*, 236*b* either separately or simultaneously. In one embodiment, each of the first, second, and third actuators 232*b*, 234*b*, 236*b*, when energized by the controller 75, supplies control pressure from the system pressure line 50 to the control port of the associated trip valves 230-280 to lock the associated trip valves 230-280 in their closed position. Likewise, when de-energized by the controller 75, the first, second and third actuators 232*b*, 234*b*, 236*b* connect the control port of the associated trip valves 230-280 to the drain line 70.

As depicted in FIGS. 5 and 6, the bleed circuit 30 disposed on each trip manifold 86*a* and 86*b* further includes a pressure reduction orifice 299*a* located between the hydraulic conduit 283 and the hydraulic fluid path 52, a pressure reduction orifice 299*b* located between the hydraulic conduit 286 and the hydraulic fluid path 52, and a pressure reduction orifice 299*c* located between the hydraulic conduit 289 and the hydraulic fluid path 52. Additionally, the bleed circuit 30 includes a pressure reduction orifice 301*a* located between the hydraulic conduit 283 and the drain line 70, a pressure reduction orifice 301*b* located between the hydraulic conduit 286 and the drain line 70, and a pressure reduction orifice 301*c* located between the hydraulic conduit 289 and the drain line 70. During normal operating conditions when all of the first-sixth trip valves 230-280 are in the closed position, the pressure in the hydraulic conduit 283, the pressure in the hydraulic conduit 286, and the pressure in the hydraulic conduit 289 are all maintained at a reduced pressure that is less than trip pressure (i.e., the pressure within the line 52) but at a pressure above zero, with the amount or value of the fluid pressure being based on the size and configuration of the orifices 299*a*-299*c* and 301*a*-301*c*. Generally speaking, the orifices 299*a*-299*c* are sized to permit a gradual flow of fluid from the line 52 into the conduits 283, 286 and 289 while the orifices 301*a*-301*c* are sized to permit a gradual flow of fluid out of the conduits 283, 286 and 289 when the pressure in the conduits 283, 286 and 289 reaches a predetermined amount (which will be a pressure less than the pressure in the line 50, such as at about half of the system pressure in the line 50). In one embodiment, the orifices 299*a*-299*c* and 301*a*-301*c* may be approximately 0.031 inches in diameter, although other sizes may be used if desired. The purpose of providing the reduced fluid pressure in the conduits 283, 286 and 289 will be described in more detail in the following discussion.

To ensure that all of the components work properly to perform a trip operation when required or desired, the components associated with the bleed circuit 30 may be tested while the turbine 11 is operating online without interrupting operation of the turbine 11. For testing purposes, the bleed circuit 30 includes first, second, and third pressure transmitters (PT1-PT3) 300-320 configured to sense the pressure between the trip valves in the first, second, and third trip branches 200-220, respectively, and, in particular, to sense the fluid pressure in the conduits 283, 286 and 289, respectively. Additionally, as illustrated best in FIG. 6, the bleed circuit 30 may include first, second, and third take offs for externally connected pressure sensors labeled as TP-A, TP-B and TP-C in FIG. 6, which are configured to enable the sensing of the fluid pressure in hydraulic conduits 295-297, respectively. Likewise, as illustrated in FIG. 6, pressure sensor connection may be established at other points in the circuit, so as to measure pressure in the drain line 70 (at TP-DR), pressure in the system pressure line 50 (at TP-P), pressure in the trip header line 52 (at TP-TH) and pressure in the return line 60 (at TP-R). While Schrader valves are used in the embodiment of FIG. 6, other types of valve may be used to enable externally pressure sensors to be mounted or connected to the trip circuit of FIG. 6. Alternatively, pressure sensors or pressure transmitters may be mounted on or in the trip manifolds to measure these or other pressures within the trip circuit.

In any event, as illustrated in FIG. 6, a pressure sensor could be connected at TP-A to sense the fluid pressure in the hydraulic conduit 295 which couples the first actuator 232*b* to the control port of both the first trip valve (A1) 230 and the fifth trip valve (A2) 270, a pressure sensor could be connected at TP-B to sense the fluid pressure in the hydraulic conduit 296 that couples the second actuator 234*b* to the control port of both the second trip valve (B1) 240 and the sixth trip valve (B2) 280, and a pressure sensor could be connected at TP-C to sense the fluid pressure in a hydraulic conduit 297 that couples the third actuator 236*b* to the control port of both the third trip valve (C1) 250 and the fourth trip valve (C2) 260. If desired, these pressure sensors could also be connected the controller 75 although they need not be. As will be described in greater detail below, the operation of the components associated with each of the plurality of redundant valve systems or branches 200-220 may be tested by monitoring the fluid pressure in each of the hydraulic conduits 283, 286, 289 and, if desired, 295, 296, 297.

During normal operating conditions (i.e., when the turbine 11 is not tripped), the controller 75 is configured to simultaneously energize each of the first, second, and third solenoid actuators 232*b*, 234*b*, 236*b* to activate the first-sixth trip valves 230-280. When the first, second, and third solenoid actuators 232*b*, 234*b*, 236*b* are energized, control pressure is supplied at the control port of each of the first-sixth trip valves 230-280, thereby causing the first-sixth trip valves 230-280 to be locked in the closed position. At this time, hydraulic fluid is blocked or prevented from flowing between the operational ports of those valves and, as a result, no direct path exists between the hydraulic fluid path 52 and the return path 60. This configuration maintains sufficient hydraulic pressure within the hydraulic fluid path 52 at the trip input of the steam valve 40 to hold the steam valve 40 in the open position. When the steam valve 40 is held in the open position, steam is delivered to the turbine 11 and the turbine 11 operates normally.

During abnormal conditions or malfunctions, it may be desirable to stop operation of the turbine 11 to prevent damage to the turbine 11 and/or to prevent other catastrophes. To do so, the controller 75 creates a bleed fluid path between the hydraulic fluid path 52 and the return path 60 to thereby remove hydraulic pressure from the hydraulic fluid path 52. The bleeding of pressure from the fluid path 52 causes the trip input of the steam valve 40 to become depressurized, thereby moving the steam valve 40 to the closed position and preventing the delivery of steam to the turbine 11. This action causes and is referred to as a tripping or halting of the turbine 11.

To determine if a trip is needed, the controller 75 may monitor turbine parameters such as, for example, turbine speed, turbine load, vacuum pressure, bearing oil pressure, thrust oil pressure, and the like using various sensors (not shown). As will be understood, the controller 75 may be configured to receive information from these sensors during operation of the turbine 11 to monitor operating conditions of the turbine 11, to thereby detect abnormal operating conditions and problems associated with the turbine 11 that may require that the turbine 11 be shut down. In response to information received from the operational sensors such as, for example, the detection of an overspeed condition, the controller 75 may cause a trip operation to be performed. To actually effectuate such a trip, the components associated with only two of the redundant valve systems or branches 200-220 of the bleed circuit 30 need to operate properly. However, to cause a trip, the controller 75 will generally operate (actually deactivate) each of the actuators 232*b*, 234*b*, 236*b* to thereby attempt to open each of the trip valves 230-280 and create three parallel bleed fluid paths between the hydraulic fluid line 52 and the return path 60. In this manner, the trip control system helps to assure that a trip will be performed even if one of the components of the bleed circuit 30 fails to operate properly because, in that case, at least one bleed fluid path will still be created or opened between the hydraulic fluid path 52 and the return path 60, thus causing a trip.

More particularly, during a trip operation, the controller 75 may be configured to simultaneously de-energize each of the first, second, and third actuators 232*b*, 234*b*, 236*b*, so that hydraulic fluid is permitted to flow through each of the first trip branch 200, the second trip branch 210, and the third trip branch 220, thereby dumping pressure off the trip input of the steam valve 40 to stop operation of the turbine 11. Additionally, the control valves 232*a*, 234*a*, 236*a* will close due to loss of pressure at their control inputs and disconnect the system pressure line 50 from the trip header line 52. As will be understood from FIG. 3, when the controller 75 de-energizes the first actuator 232*b*, the control ports of both the first trip valve (A1) 230 and the fifth trip valve (A2) 270 are coupled through the actuator 232*b* to the drain 70. As a result, control or system pressure from the system pressure line 50 is released or removed from each of the control ports of the first trip valve (A1) 230 and the fifth trip valve (A2) 270, and the pressure within the control line for these valves is diverted or bled to the drain or tank 70. At this time, both of the first trip valve (A1) 230 and the fifth trip valve (A2) 270 move from the closed position to the open position and hydraulic fluid is permitted to flow through the operational ports (A, B in FIG. 5 or 1, 2 in FIG. 6) of the first trip valve (A1) 230 and the fifth trip valve (A2) 270.

Similarly, when the controller 75 de-energizes the second actuator 234*b*, the control ports of both the second trip valve (B1) 240 and the sixth trip valve (B2) 280 are coupled through the actuator 234*b* to the drain 70. As a result, control or system pressure from the line 50 is released or removed at each of the control ports of the second trip valve (B1) 240 and the sixth trip valve (B2) 280, and the pressure within the control line for these valves is immediately diverted or bled to the drain 70. At this time, both of the second trip valve (B1) 240 and the sixth trip valve (B2) 280 move from the closed position to the open position which enables hydraulic fluid to flow through the operational ports of the second trip valve (B1) 240 and the sixth trip valve (B2) 280.

Likewise, when the controller 75 de-energizes the third actuator 236*b*, the control ports of both the third trip valve (C1) 250 and the fourth trip valve (C2) 260 are coupled through the actuator 236*b* to the drain 70. As a result, control or system pressure is released or removed from each of the control ports of the third trip valve (C1) 250 and the fourth trip valve (C2) 260, and the pressure within the control line for these valves is immediately diverted or bled to the drain 70. At this time, both of the third trip valve (C1) 250 and the fourth trip valve (C2) 260 move from the closed position to the open position which permits hydraulic fluid to flow through the operational ports of the third trip valve (C1) 250 and the fourth trip valve (C2) 260.

As will be understood, to effectuate a trip operation, hydraulic fluid in the fluid path 52 need only flow to the return path 60 via one of the first, second, or third trip branches 200-220 to, thereby depressurize the trip input of the steam valve 40 and stop operation of the turbine 11. As a result, the components associated with only two of the redundant valve systems A1, A2, A3, B1, B2, B3 or C1, C2, C3 need to operate properly to perform a trip operation. In other words, if all of the components associated with the first valve system (e.g., the first actuator 232*b*, the first trip valve (A1) 230, the fifth trip valve (A2) 270 and the control valve (A3) 232*a*) operate properly, and if all of the components associated with the second valve system (e.g., the second actuator 234*b*, the second trip valve (B1) 240, and the sixth trip valve (B2) 280 and the control valve (B3) 234*a*) operate properly, then hydraulic fluid may flow from the hydraulic fluid path 52 to the return path 60 via the first trip branch 200, thereby dumping trip pressure off the steam valve 40 and stopping operation of the turbine 11. Similarly, if all of the components associated with the second valve system operate properly, and if all of the components associated with the third valve system (e.g., the third actuator 236*b*, the third trip valve (C1) 250, and the fourth trip valve (C2) 260 and the control valve (C3) 236*a*) operate properly, then hydraulic fluid may flow from the hydraulic fluid path 52 to the return path 60 via the second trip branch 210, thereby dumping trip pressure off the steam valve 40 and stopping operation of the turbine 11. Still further, if all of the components associated with the third and first valve systems operate properly, then hydraulic fluid may flow from the hydraulic fluid path 52 to the return path 60 via the third trip branch 220, thereby dumping trip pressure off the steam valve 40 and stopping operation of the turbine 11. In this manner, redundancy is achieved by requiring that the components associated with only two of the three valve systems operate properly to perform a trip operation. In other words, the failure of one or more components associated with one of the branches 200-220 will not prevent the controller 75 from performing a trip operation to stop the turbine 11.

Still further, it is desirable, from time to time, to test the components associated with the bleed circuit 30 while the turbine 11 is online and operating to ensure that all of these components work properly. However, it is desirable to test these components without interrupting the operation of the turbine 11, as stopping the turbine 11 for testing or maintenance is costly and undesirable. In the system illustrated in FIGS. 5 and 6, the controller 75 may remotely test the operation of each of the redundant valve branches 200-220 individually while the turbine 11 is online and operating. In particular, to perform a test, the controller 75 may actuate (or de-actuate) the actuators 232*b*, 234*b*, 236*b* individually and monitor the pressure in one or more of the hydraulic conduits 283, 286, 289 and, if desired the conduits 295, 296, and 297, using the pressure transmitters (PT1-PT3) 300, 310, 320, and those connected at, for example, TP-A, TP-B and TP-C to determine if the components associated with the bleed circuit 30 are operating properly. In this manner, a human operator is not required to perform manual tests on the various valves (A1, A2, B1, B2, C1, C2) 230-280 and actuators 232*b*, 234*b*, 236*b*, which requires that the turbine 11 be shut down. Moreover, when the controller 75 is testing the components associated with the bleed circuit 30, the controller 75 maintains the ability to stop operation of the turbine 11 (i.e., trip the turbine 11) upon the occurrence of an abnormal condition or malfunction to prevent damage to the turbine 11 and/or to prevent other catastrophes.

More specifically, to test the operation of the first actuator system 232 (including the control valve 232*a* and the solenoid valve 232*b*), the first trip valve (A1) 230, and the fifth trip valve (A2) 270 associated with the first valve system 232, the controller 75 de-energizes the solenoid valve 232*b* while keeping the solenoid valves 234*b* and 236*b* energized. When the controller 75 de-energizes the first solenoid valve 232*b*, the control ports of both the first trip valve (A1) 230 and the fifth trip valve (A2) 270 should be coupled to the drain 70 and thus control pressure should be released or removed from each of the control ports of the first trip valve (A1) 230 and the fifth trip valve (A2) 270. Additionally, the control valve 232*a* (which loses fluid pressure at the control port thereof), should close, thereby disconnecting the path from the system pressure line 50 to the trip header line 52. If all of these components are operating properly, when the first actuator 232*b* is de-energized, both of the first trip valve (A1) 230 and the fifth trip valve (A2) 270 should thus move from the closed position to the open position. By monitoring the pressure sensed by the first pressure transmitter (PT1) 300 at the hydraulic conduit 283, the pressure sensed by the second pressure transmitter (PT2) 310 at the hydraulic conduit 286, and/or the pressure sensed by the third pressure transmitter (PT3) 320 at the hydraulic conduit 289, the controller 75 can determine whether one or more of the first actuator 232*b*, the first trip valve (A1) 230, and the fifth trip valve (A2) 270 are operating properly.

In particular, if each of the first solenoid actuator 232*b*, the first trip valve (A1) 230, and the fifth trip valve (A2) 270 is operating properly when the controller 75 de-energizes the first solenoid actuator 232*b*, the first pressure transmitter (PT1) 300 should sense system or trip header pressure at the hydraulic conduit 283 (due to the opening of the first trip valve (A1) 230, the second pressure transmitter (PT2) 310 should sense a small or negligible pressure change at the hydraulic conduit 286 and the third pressure transmitter (PT3) 320 should sense drain pressure at the hydraulic conduit 289 due to the fifth trip valve (A2) 270 opening to connect the conduit 289 to the return line 60.

However, if the first pressure transmitter (PT1) 300 senses no or only a small pressure change at the hydraulic conduit 283 after the controller 75 de-energizes the first actuator 232*b* while sensing drain pressure at the transmitter (PT3) 320, the controller 75, to the extent it receives a measurement from the pressure transmitter 300, may determine that the first trip valve (A1) 230 is not working properly. On the other hand, if the first pressure transmitter (PT1) 300 senses trip header pressure at the hydraulic conduit 283 after the controller 75 de-energizes the first actuator 232*b* while sensing no or little pressure change at the transmitter (PT3) 320, the controller 75 may determine that the fifth trip valve (A2) 270 is not working properly. In the case in which both the first pressure transmitter (PT1) 300 and the third pressure transmitter (PT3) 320 senses no or only a small pressure change at the hydraulic conduits 283 and 289 after the controller 75 de-energizes the first actuator 232*b*, the controller 75 may determine that the solenoid valve 232*b* is not working properly. In any of these cases, the controller 75 may generate a fault or alarm signal or take any other desired action to notify a user of the specific problem. Of course, the controller 75 may also sense a problem with the solenoid valve 232*b* if the controller senses changes to the pressures measured by the pressure transmitters PT1 and PT3 when the controller 75 is energizing the solenoid valve 232*b*, as this means that the solenoid valve 232*b* may have stopped functioning and closed in response to the bias on that valve.

The second valve system 234, the second trip valve (B1) 250, and the sixth trip valve (B2) 280 associated with the second valve system 234 may be tested in a manner similar to the manner described above with respect to the first valve system 232. Specifically, when the controller 75 de-energizes the second actuator 234*b*, while keeping the first solenoid actuator 223*b* and the third solenoid actuator 236*b* energized, the control ports of both the second trip valve (B1) 250 and the sixth trip valve (B2) 280 should be coupled through the actuator 234*b* to the drain 70 and thus control or system pressure should be released or removed from each of the control ports of the third trip valve (B1) 250 and the sixth trip valve (B2) 280. Thus, if the second valve system 234 is operating properly when the actuator 234*b* is de-energized, both of the third trip valve (B1) 250 and the sixth trip valve (B2) 280 should move from the closed position to the open position. By monitoring the pressure sensed by the first pressure transmitter (PT1) 300 at the hydraulic conduit 283, the pressure sensed by the second pressure transmitter (PT2) 310 at the hydraulic conduit 286, and/or the pressure sensed by the third pressure transmitter (PT3) 320 at the hydraulic conduit 289, the controller 75 may determine whether one or more of the second actuator 234*b*, the third trip valve (B1) 250, and the sixth trip valve (B2) 280 are operating properly.

In particular, if the second actuator 234*b*, the third trip valve (B1) 250, and the sixth trip valve (B2) 280 are operating properly when the controller 75 de-energizes the second actuator 234*b*, the first pressure transmitter (PT1) 300 should detect drain pressure at the hydraulic conduit 283 due to the opening of the trip valve 280 that couples the outlet of the first trip valve (A1) 230 to return line 60. Additionally, the second pressure transmitter (PT2) 310 should sense trip header pressure at the conduit 286 due to the opening of the valve 240 (B1) while the trip valve (C2) 260 remains closed. Moreover, the third pressure transmitter (PT3) 320 should sense only a small or negligible pressure change in the hydraulic conduit 289 as operation of the trip valves 250 and 270 remain unaffected.

However, if the second pressure transmitter (PT2) 310 senses no or only a small pressure change at the hydraulic conduit 286 after the controller 75 de-energizes the second actuator 234*b* while sensing drain pressure at the transmitter (PT1) 300, the controller 75 may determine that the second trip valve (B1) 240 is not working properly. On the other hand, if the first pressure transmitter (PT2) 310 senses trip header pressure at the hydraulic conduit 286 after the controller 75 de-energizes the first actuator 234*b* while sensing no or little pressure change at the pressure transmitter (PT1) 300, the controller 75 may determine that the sixth trip valve (B2) 280 is not working properly. In the case in which both the first pressure transmitter (PT1) 300 and the second pressure transmitter (PT3) 310 senses no or only a small pressure change at the hydraulic conduits 283 and 286 after the controller 75 de-energizes the second solenoid actuator 234*b*, the controller 75 may determine that the solenoid valve 234*b* is not working properly. In any of these cases, the controller 75 may generate a fault or alarm signal or take any other desired action to notify a user of the specific problem and the detected source or cause of the problem. Of course, the controller 75 may also sense a problem with the solenoid valve 234*b* if the controller 75 senses changes to the pressures measured by the pressure transmitter PT1 and PT2 when the controller 75 is energizing the solenoid valve 234*b*, as this situation means that the solenoid valve 234*b* may have stop functioning and closed in response to the bias on that valve without being instructed by the controller 75 to do so.

The third actuator or valve system 236, the third trip valve (C1) 250, and the fourth trip valve (C2) 260 associated with the third valve system 236 may be tested in a similar manner as the first valve system and the second valve system. Specifically, when the controller 75 de-energizes the third solenoid actuator 236*b*, while keeping the first solenoid actuator 232*b* and the second solenoid actuator 234*b* energized, the control ports of both the third trip valve (C1) 250 and the fourth trip valve (C2) 260 should be coupled to the drain 70 and control pressure should be released or removed from each of the control ports of the third trip valve (C1) 250 and the fourth trip valve (C2) 260. Moreover, if the third solenoid actuator 236*b* is operating properly when de-energized by the controller 75, both of the third trip valve (C1) 250 and the fourth trip valve (C2) 260 should move from the closed position to the open position. By monitoring one or more of the pressures sensed by the second pressure transmitter (PT2) 310 at the hydraulic conduit 286, the pressure sensed by the third pressure transmitter (PT3) 330 at the hydraulic conduit 289, the controller 75 may determine whether one or more of the third actuator system 236, the third trip valve (C1) 250, and the fourth trip valve (C2) 260 are operating properly.

In particular, if each of the third actuator 236*b*, the fourth trip valve (C1) 250, and the fifth trip valve (C2) 260 is operating properly when the controller 75 de-energizes the third actuator 236*b* while keeping the first actuator 232*b* and the second actuator 234*b* energized, the second pressure transmitter (PT2) 310 should drain pressure at the hydraulic conduit 286 that couples the second trip valve (B1) 240 to the fourth trip valve (C2) 260 due to the opening of the fourth trip valve (C2) 260. Additionally, the third pressure transmitter (PT3) 320 should sense trip header pressure at the hydraulic conduit 289 due to the third trip valve (C1) 250 being in the open position and the fifth trip valve (A2) 270 being in the closed position. The controller 75 may determine which components are faulty by monitoring the pressures at the pressure transmitters PT2 and PT3 in a manner similar to that described above with respect to the testing of the other fluid paths.

Of course, if desired, the controller 75 may receive signals from other pressure sensors mounted at locations illustrated in FIG. 6 if so desired, and may also or instead use these signals to diagnose one or more faults within or associated with the trip valves in addition to or instead of using the signals from the pressure transmitters PT1, PT2 and PT3 in the manner discussed above.

As can be seen, the operation of a trip of the turbine 11 is not prevented during the testing of any one of the valve systems 232, 234, 236 associated with the trip valves 230-280 because, during a test, the controller 75 is essentially controlling one of the three valve systems to simulate a trip for that valve system. Thus, to actuate an actual trip during a test, the controller 75 need only send a trip signal to one or both of the other valve systems (not undergoing the test) by de-energizing one or both of the actuators 232*b*, 234*b*, 236*b* associated with the other valve systems.

Moreover, as illustrated in FIG. 6, manually operated valves, such as needle valves 350, may be disposed between the pressure transmitters 300, 310 and 320 and the lines to which these transmitters attach to, for example, to enable these transmitters to be isolated from the fluid lines to allow these transmitters to be repaired or replaced. Still further, if desired, another valve, such as a manually operated needle valve may be disposed between the line 50 which supplies system pressure to the bleed circuit 30 and the line 52 to enable a user to manually pressurize the line 52 at any desired time or to compensate for leakage in the line 52.

As will be understood, the bleed circuit 30 described above is configured to electronically perform a trip operation from a remote location in response to abnormal conditions or malfunctions by bleeding the hydraulic fluid in the hydraulic fluid path 52 to the return path 60 using a two out of three voting scheme, thereby removing pressure from the trip input of the steam valve 40. In addition, because of the two out of three redundancy, the components of this bleed circuit 30 can be tested individually during operation of the turbine 11, but without preventing the controller 75 from effectuating an actual trip during the test. As a result, a human operator is not required to manually operate or test the components associated with the bleed circuit 30. Furthermore, the plurality of redundant valve systems associated with the bleed circuit 30 described above helps to ensure that a trip operation can be performed even if one of the components associated with the bleed circuit fails to operate. As a result, the bleed circuit 30 described herein provides greater reliability that a trip operation will be performed when desired or required.

However, due to the operation of the porting manifold 84 and the needle valves 95 disposed thereon, and due to the inclusion of two trip manifolds 86*a* and 86*b*, each having an independent bleed circuit disposed thereon, components on one of the trip manifolds 86*a* or 86*b* can be repaired or replaced while the other trip manifold 86*a* or 86*b* continues to operate so as to enable tripping of turbine 11 if needed. In fact, one of the trip manifolds 86*a* or 86*b* can be isolated from and physically removed from the porting manifold 84 while the turbine 11 is on-line and running without affecting the ability of the other trip manifold to operate to cause a trip of the turbine 11 if needed. After being removed, the various components thereon can be repaired or replaced and the trip manifold can then be reconnected to the system while the turbine 11 is running. This bleed circuit configuration thus provides for the use of redundant trip manifolds in conjunction with the needle valves 95 (which are used to isolate one of the trip manifolds from the bleed circuit while the other trip manifold continues to operate) to enable components of the bleed circuit to be removed and repaired or replaced while the turbine and the trip system is operating on-line. This configuration thus provides a system that does not require an operator or other user to shut down the turbine 11 in order to fix problems or faulty components detected during the testing operations described above.

More particularly, to isolate one of the trip manifolds during on-line operation of the turbine, an operator, maintenance person or other person may actuate the needle valves 95 associated with the trip manifold being removed (either of set A or B as illustrated in FIG. 3) so as to isolate the ports of the trip manifold being removed from the fluid lines within the porting manifold 84. Then, the bolts 97 (FIG. 2) for of the associated trip manifold may be loosened and removed to enable the trip manifold to be removed from the porting manifold. However, because the bleed circuit on the other trip manifold operates independently and in parallel to the bleed circuit on the trip manifold being removed, no trip of the turbine is caused by this action, thereby enabling one of the trip manifolds to be removed while the turbine and trip control system continue to operate on-line. Generally, it is desirable to close the needle or pin valve 95 in a particular order to assure that removal of the trip manifold does not cause a reduction of pressure in the trip header line 52. In particular, it is desirable to close the pin or needle valve 95 that isolates the trip header line (52*a* or 52*b*) connected to the trip manifold being removed first, and to then close the pin or needle valve 95 that isolates the system pressure line 50 from the trip manifold being removed. Thereafter, the drain and tank lines may be isolated in either order by actuating the appropriate pin or needle valve 95. Of course, the opposite order may be used to connect a trip manifold and associated components to the porting manifold 84 when the turbine 11 is operating on-line to assure proper continued operation without a trip. While not illustrated as such in FIGS. 2-3, the pin or needle valves 95 may be disposed in line along the side of the porting manifold 84 in the order (e.g., right to left or left to right) in which these valves should be actuated to remove or connect the trip manifold 86 to the porting manifold 84 while the turbine 11 is operating on-line without causing a trip.

Still further, to make mounting of the trip manifolds 86*a* and 86*b* onto the porting manifold 84 easier, O-ring connections 360 are used at each of the ports between these two manifolds. Such O-ring connections 360 are illustrated in FIG. 6 at each of the connections of the drain line 70, the system pressure line 50, the trip header 52 and the return line 60. These O-ring connectors 360 provide a sealed connection between the porting manifold 86 and the trip manifold 86 when the bolts 97 (FIG. 2) are tightened without the need of tubing or external fluid conduits. Such O-ring connections may be used at the ports 90, 91*a*, 91*b* and 92 of the porting manifold 84 as well to enable the porting manifold 84 to be mounted directly to manifolds holding other circuits, such as a block circuit.

Moreover, because each of the bleed paths of the bleed circuits on the trip manifolds 86*a*, 86*b* has a control valve (i.e., one of the valves 232*a*, 234*a*, 236*a*) that opens in response to the operation or actuation of the associated solenoid valve 232*b*, 234*b*, 236*b*) to connect the system pressure line 50 to the trip header line 52, there is always, when a trip state is not initiated, one or more fully open fluid paths between the system pressure line 50 and the trip header line 52 so that full pressure can be supplied to the trip header line 52 during this time. Moreover, when the solenoid valves 232*b*, 234*b*, 236*b* are closed or are de-energized, e.g., during a trip state, the control valves 232*a*, 234*a*, 236*a* fully close to seal all of the connection between the system pressure line 50 and the trip header line 52. This operation eliminates the need for disposing small fluid ports between these lines, as has been done in the past, which ports needed to be sized in a manner that was a trade-off between best operation during a non-tripped state and best operation during a tripped state. The control valve systems described herein in the bleed circuit overcome this problem and operate automatically in conjunction with the control system.

Figure 7:
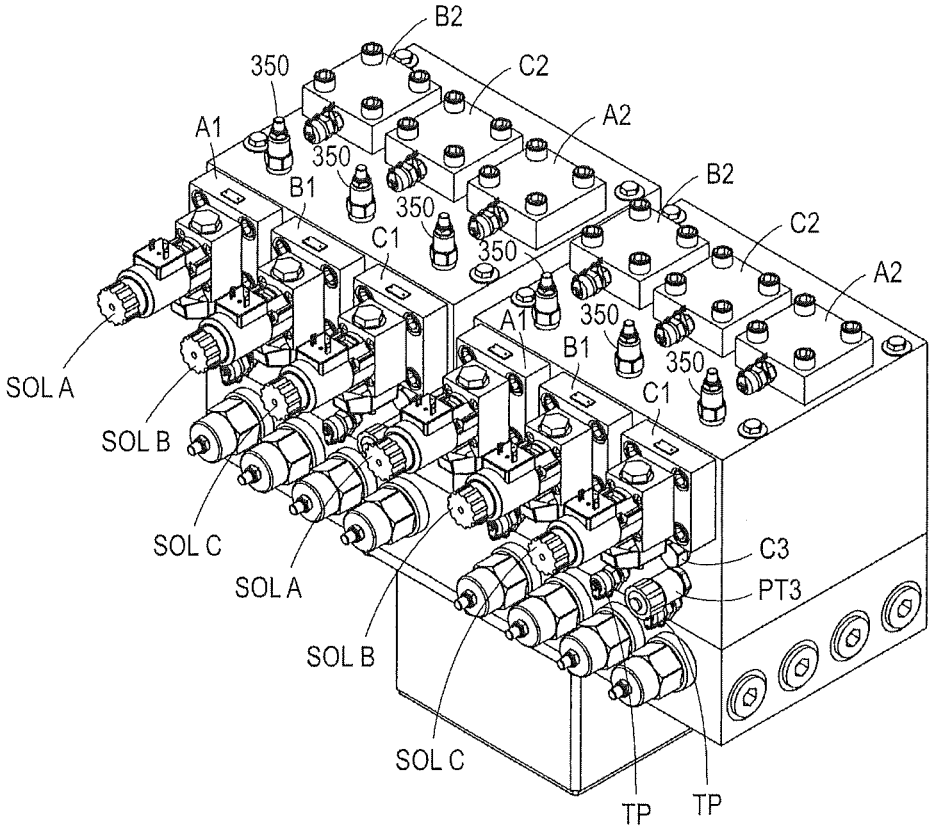
FIG. 7 is a three-dimensional perspective view of the bleed circuit having multiple trip manifolds a porting manifold and a tank as well as various valve and sensor components removably mounted thereto to form an integrated trip bleed circuit.

By way of example, FIG. 7 depicts one configuration of a bleed trip circuit illustrating the manner in which various of the components described with respect to FIGS. 5 and 6 may be mounted on the trip manifolds 86*a* and 86*b* and the porting manifold 84. Of course, other manners of implementing the described bleed circuit described herein could be used instead.

Referring back to FIG. 1, when the bleed circuit 30 of FIGS. 1-6 performs a bleed function to thereby initiate a trip of the turbine 11, the block circuit 20 operates to prevent or block the flow of hydraulic fluid from the hydraulic fluid source to the turbine trip header while the turbine 11 is in the trip state. As illustrated in FIG. 1, the block circuit 20 is hydraulically located upstream from and is coupled to the bleed circuit 30 to perform the block function. In particular, the block circuit 20 may operate to block the pressure line 52 from the hydraulic pressure source (not shown in the figures but located upstream of the block circuit 20) or to block the system pressure line 50, to prevent unnecessary cycling of hydraulic fluid through the pressure lines 50 and 52 and the return path 60 during a trip state of the turbine 11. The block circuit 20 may operate automatically by sensing the loss of turbine trip header pressure 52. If the block circuit 20 fails to adequately block system pressure to the turbine trip header after the bleed circuit 30 removes the pressure in the line 52, the hydraulic pressure pump or source unnecessarily operates in an attempt to increase the pressure in the line 50 which, of course, cannot happen due to the operation of the bleed circuit 30 during the trip.

Preferably, the block circuit 20 includes redundancy to enable the block circuit 20 to work correctly in the presence of a failed component within the block circuit 20. Furthermore, the block circuit 20 is preferably remotely testable during operation of the turbine 11 in a manner that does not trip the turbine 11 but that enables the turbine 11 to be tripped, if necessary, during the testing of the block circuit 20. In one embodiment, the block circuit 20 may include a plurality of redundant blocking components connected in series within the hydraulic fluid line 50 and configured to block system pressure to the turbine trip header in a redundant manner after a trip has occurred. However, many different block circuits are known and can be used with the bleed circuit described herein. As a result, the specifics of the block circuit will not be described in detail herein. However, one such block circuit is described in U.S. Pat. No. 7,874,241, and the disclosure of this circuit is hereby expressly incorporated by reference herein.

It should be understood that the trip control system 10, as described above, may be retrofitted with existing mechanical hydraulic control (MHC) turbines by, for example, removing the emergency trip valve, associated linkages and other components, and inserting the tripping control system 10 in the hydraulic fluid path 50. Still further, it will be understood that, while the valves, actuators and other components have been variously described as being electronically or hydraulically controlled components biased to particular normally open or closed positions, individual ones of these actuators and valves could be electronically or hydraulically controlled in a manner other than described herein and may be biased in other manners then those described herein. Still further, in some cases, various ones of the valves or actuator may be eliminated or the functionality may be combined into a single valve device. Still further, it will be understood that the controller 75 described herein includes one or more processors and a computer readable memory which stores one or more programs for performing the tripping, testing and monitoring functions described herein. When implemented, the programs may be stored in any computer readable memory such as on a magnetic disk, a laser disk, or other storage medium, in a RAM or ROM of a computer or processor, as part of an application specific integrated circuit, etc. Likewise, this software may be delivered to a user, a process plant, a controller, etc. using any known or desired delivery method including, for example, on a computer readable disk or other transportable computer storage mechanism or over a communication channel such as a telephone line, the Internet, the World Wide Web, any other local area network or wide area network, etc. (which delivery is viewed as being the same as or interchangeable with providing such software via a transportable storage medium). Furthermore, this software may be provided directly without modulation or encryption or may be modulated and/or encrypted using any suitable modulation carrier wave and/or encryption technique before being transmitted over a communication channel.

While the present disclosure has been described with reference to specific examples, which are intended to be illustrative only and not to be limiting of the disclosure, it will be apparent to those of ordinary skill in the art that changes, additions, or deletions may be made to the disclosed embodiments without departing from the spirit and scope of the disclosure.

What is claimed:

1. A method of operating a controlled device using a trip manifold to deliver control pressure from a system pressure source to an input of a controlled device, the method comprising:

receiving a trip signal from a controller;

executing a tripping action of the trip manifold in response to receiving the trip signal from the controller, the tripping action including:

de-energizing an actuator valve of a first control valve system to couple a control input of a control valve of the first control valve system to a drain line, wherein the control valve closes a first fluid path between the system pressure line and a control pressure line;

de-energizing an actuator valve of a second control valve system to couple a control input of a control valve of the second control valve system to the drain line, wherein the control valve closes a second fluid path between the system pressure line and the control pressure line; and de-energizing an actuator valve of a third control valve system to couple a control input of a control valve of the third control valve system to the drain line, wherein the control valve closes a third fluid path between the system pressure line and the control pressure line, wherein the control pressure line is fully sealed from the system pressure line by the control valves of the first, second and third control valve systems.

2. The method of claim 1, wherein the de-energized actuator valve of the first control valve system further causing a first trip valve of the first control valve system to be coupled to the drain line and a control input of a second trip valve of the first control valve system to be coupled to the drain line;

the de-energized actuator valve of the second control valve system further causing a first trip valve of the second control valve system to be coupled to the drain line and a control input of a second trip valve of the second control valve system to be coupled to the drain line; and the de-energized actuator valve of the third control valve system further causing a first trip valve of the third control valve system to be coupled to the drain line and a control input of a second trip valve of the third control valve system to be coupled to the drain line; wherein a first bleed path between the control pressure line and the drain line is created through the first trip valve of the first control valve system and the second trip valve of the second control valve system;

a second bleed path between the control pressure line and the drain line is created through the first trip valve of the second control valve system and the second trip valve of the third control valve system; and a third bleed path between the control pressure line and the drain line is created through the first trip valve of the third control valve system and the second trip valve of the first control valve system.

3. A method of testing the operation of a redundant trip manifold system delivering control pressure to an input of a controlled device from a system pressure source in a manner that enables one of a plurality of control valve systems to be tested without preventing a tripping action, the method comprising:

de-energizing an actuator valve of a first control valve system to couple a control input of a control valve of the first control valve system to a drain line, wherein the control valve closes to fully seal a fluid path between the system pressure line and a control pressure line, the de-energized actuator valve of the first control valve system further causing a first trip valve of the first control valve system to be coupled to the drain line and a control input of a second trip valve of the first control valve system to be coupled to the drain line;

monitoring pressure at an output of the first trip valve of the first control valve system;

monitoring pressure at an input of the second trip valve of the first control valve system;

comparing the monitored pressure at the output of the first trip valve of the first control valve system to a first redundant trip valve outlet pressure level;

comparing the monitored pressure at the input of the second trip valve of the first control valve system to a second redundant trip valve inlet pressure level;

executing a first command indicating an operating condition of the first trip valve of the first control valve system based on the comparison of the monitored pressure at the output of the first trip valve of the first control valve system to the first redundant trip valve outlet pressure level; and executing a second command indicating an operating condition of the second trip valve of the first control valve system based on the comparison of the monitored pressure at the inlet of the second trip valve of the first control valve system to the first redundant trip valve inlet pressure level.

* * * * *